US010913281B2

(12) United States Patent
Chino et al.

(10) Patent No.: US 10,913,281 B2
(45) Date of Patent: Feb. 9, 2021

(54) LIQUID DISCHARGE DEVICE AND METHOD OF CONTROLLING LIQUID DISCHARGE DEVICE

(71) Applicant: SEIKO EPSON CORPORATION, Tokyo (JP)

(72) Inventors: Toru Chino, Shiojiri (JP); Koki Fukasawa, Shiojiri (JP); Takayuki Tamaki, Shiojiri (JP); Toshiaki Ishikawa, Matsumotoi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/506,958

(22) Filed: Jul. 9, 2019

(65) Prior Publication Data

US 2020/0016901 A1 Jan. 16, 2020

(30) Foreign Application Priority Data

Jul. 10, 2018 (JP) ..... 2018-130786

(51) Int. Cl.

| | |
|---|---|
| ***B41J 2/165*** | (2006.01) |
| ***B41J 2/175*** | (2006.01) |
| ***B41J 11/00*** | (2006.01) |
| ***B41J 29/38*** | (2006.01) |

(52) U.S. Cl.

CPC ..... *B41J 2/17506* (2013.01); *B41J 2/16511* (2013.01); *B41J 11/007* (2013.01); *B41J 29/38* (2013.01)

(58) Field of Classification Search

CPC ..... B41J 2/16526; B41J 2/16517; B41J 2/16508; B41J 29/13; B41J 11/42; B41J 13/0018; B41J 2/15; B41J 25/34; B41J 2/17566; B41J 2/1752; B41J 2/17509; B41J 2/17503; B41J 2/17506; B41J 2/17513; B41J 2/17523; B41J 2/17526; B41J 2/1753; B41J 2/17533; B41J 2/17536

See application file for complete search history.

(56) References Cited

FOREIGN PATENT DOCUMENTS

| | | |
|---|---|---|
| EP | 1 386 742 A2 | 2/2004 |
| JP | H10-323991 A | 12/1998 |

*Primary Examiner* — Kristal Feggins
(74) *Attorney, Agent, or Firm* — Chip Law Group

(57) ABSTRACT

A liquid discharge device includes a discharge head configured to discharge a liquid on a medium conveyed, a carriage on which the liquid discharge head and a liquid cartridge are mounted configured to move in an X-axis direction, a cap disposed outside a conveying area in the X-axis direction, and configured to have contact with a nozzle surface of the discharge head on which a nozzle opens, and a control section configured to control moving of the carriage. When one of the replacement of the liquid cartridge and refill of the liquid container is performed, the control section locates the carriage at the first position where the nozzle surface is opposed to the area between the conveying area and the cap in the X-axis direction.

8 Claims, 11 Drawing Sheets

LIQUID DISCHARGE DEVICE AND METHOD OF CONTROLLING LIQUID DISCHARGE DEVICE

The present application is based on, and claims priority from JP Application Serial Number 2018-130786, filed Jul. 10, 2018, the disclosure of which is hereby incorporated by reference herein in its entirety.

BACKGROUND

The present disclosure relates to a discharge head for discharging a liquid to a medium, a carriage for moving the discharge head, a liquid discharge device in which a liquid container for containing the liquid to be supplied to the discharge head is mounted on the carriage, and a method of controlling the liquid discharge device.

In the past, as a liquid discharge device of this kind, there has been known an inkjet-type recording device having a discharge head discharging ink as an example of a liquid to print a document or an image on a medium such as a form. For example, in a recording device described in JP-A-10-323991 (Document 1), there is adopted a cartridge replacement method for preventing a platen from getting dirty due to the ink flying when replacing the ink cartridge as an example of the liquid container. In this recording device, when a cartridge replacing mode is instructed, one of recording sheets in a paper cassette is fed, and is then disposed between a recording head and the platen. The cartridge is removed, and is then replaced with a new cartridge by the user in the state in which the cartridge is located at a replacement position. After replacing the cartridge, the recording sheet mounted between the recording head and the platen is discharged, and at the same time, the carriage is moved from the replacement position of the cartridge to a maintenance position to perform cleaning of the recording head.

However, in the recording device described in Document 1, one medium such as the recording sheet is wasted when replacing the cartridge. Further, when performing a printing operation on a continuous medium such as a continuous form fed from a roll body such as a paper roll, the cartridge replacement is performed while keeping the medium left in a conveying area when liquid end occurs during the printing operation. When replacing the cartridge, besides the ink flying when removing the cartridge, the liquid is leaked from a nozzle of the discharge head to adhere to a nozzle surface, or to drop as a droplet in some cases due to an influence of pushing pressure applied to the carriage when mounting the cartridge. After the replacement of the cartridge, there is a problem that there is a possibility that the medium gets dirty with the liquid dropped as a droplet from the discharge head to the medium, or with the liquid on the nozzle surface scraping against the medium slacking in the process of the translation of the discharge head from the replacement position of the cartridge to the maintenance position facing a cap provided to a maintenance device.

It should be noted that regarding the problem of this kind, also in the type in which the liquid container mounted on the carriage is a tank, and the liquid is injected into the liquid container while keeping the liquid container mounted on the carriage, the liquid is leaked from the nozzle of the discharge head in some cases due to an influence of pressing pressure of a bottle when injecting the liquid, or pushing pressure when fitting a plug section in an inlet of the liquid container after injecting the liquid. Therefore, the problem described above is common to the liquid discharge devices each provided with a carriage capable of mounting the liquid container.

SUMMARY

According to one embodiment, a liquid discharge device includes a discharge head configured to discharge a liquid on a medium conveyed, a carriage on which the discharge head and a liquid container configured to move in a first axis direction, the liquid container being configured to contain the liquid to be supplied to the discharge head, a cap disposed outside a conveying area in the first axis direction, and configured to have contact with a nozzle surface of the discharge head opens, the nozzle surface being a surface on which a nozzle opens, and the conveying area being a range in which the medium is conveyed, and a control section configured to control moving of the carriage, wherein the control section locates the carriage at a first position where the nozzle surface faces to an area between the conveying area and the cap in the first axis direction when one of replacement of the liquid container and refill of the liquid container with the liquid is performed.

In another embodiment, a method of controlling a liquid discharge device, the liquid discharge device including a discharge head configured to discharge a liquid on a medium conveyed, a cap configured to have contact with a nozzle surface of the discharge head, the nozzle surface being a surface on which a nozzle opens, and a carriage on which the discharge head and the liquid container are mounted configured to move in a first axis direction, includes: moving the carriage to locate the nozzle surface at a position where the nozzle surface faces to an area between a conveying area of the medium and the cap in the first axis direction when one of replacement of the liquid container and refill of the liquid container with the liquid is performed.

DESCRIPTION OF EXEMPLARY AN EMBODIMENT

Embodiments of the liquid discharge device hereinafter are described with reference to the drawings. The liquid discharge device according to the present embodiment is an inkjet-type printer for jetting ink as an example of the liquid to a medium such as a form to print characters, an image or the like on the medium.

Figure 1:
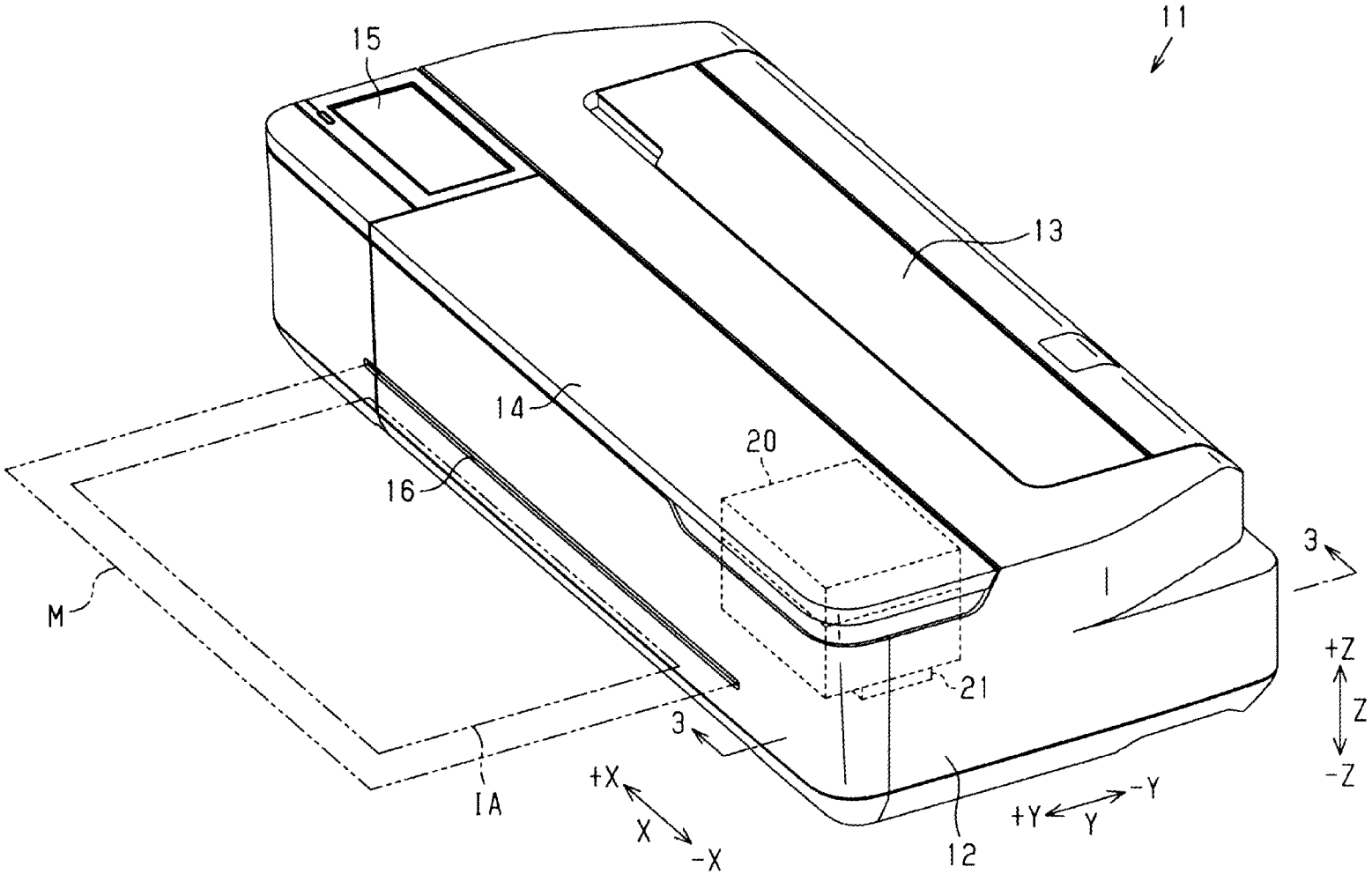
FIG. 1 is a perspective view showing a liquid discharge device in an embodiment.

In FIG. 1, a vertical direction is represented by a Z axis, and directions parallel to a horizontal plane are defined as an X-axis direction and a Y-axis direction assuming that the liquid discharge device 11 is installed on the horizontal plane. In other words, the X-axis direction corresponding to the width direction, the Y-axis direction corresponding to the depth direction and the Z-axis direction corresponding to the vertical direction when viewing the liquid discharge device 11 from the front are directions different from each other, and are perpendicular to each other. In the depth direction, one end side is referred to as a front surface side or a front side, and the other end side opposite to the one end side is referred to as a back surface side or a rear side in some cases. It should be noted that the X-axis direction corresponds to an example of a first axis direction, and the Y-axis direction corresponds to an example of a second axis direction.

As shown in FIG. 1, the liquid discharge device 11 is provided with a housing 12 having a substantially rectangular solid shape. On an upper surface of the housing 12, there are disposed a paper feed cover 13 located on the rear side and a maintenance cover 14 located on the front side so as to be able to be opened and closed. At a position adjacent in the X-axis direction to the maintenance cover 14 in the upper surface of the housing 12, there is disposed an operation panel 15 for performing a variety of operations of the liquid discharge device 11.

As shown in FIG. 1, inside the housing 12, there is disposed a carriage 20 so as to be able to be translated in the X-axis direction. On the carriage 20, there is mounted a discharge head 21 capable of discharging a liquid such as ink to a medium M conveyed. The discharge head 21 is fixed to a bottom part of the carriage 20 so as to be able to be opposed to the medium M conveyed. By discharging the liquid from the discharge head 21 toward the medium M while the carriage 20 is reciprocating in the X-axis direction, an image or a document is printed in a printed area IA as an area on which droplets are discharge in the medium M. The liquid discharge device 11 is provided with an outlet 16 in a front surface the housing 12. The medium M having been printed with the image and so on formed by the discharge head 21 discharging the liquid inside the housing 12 is ejected from the outlet 16. In the present embodiment, the X-axis direction coincides with a scanning axis as a moving direction of the carriage 20.

Figure 2:
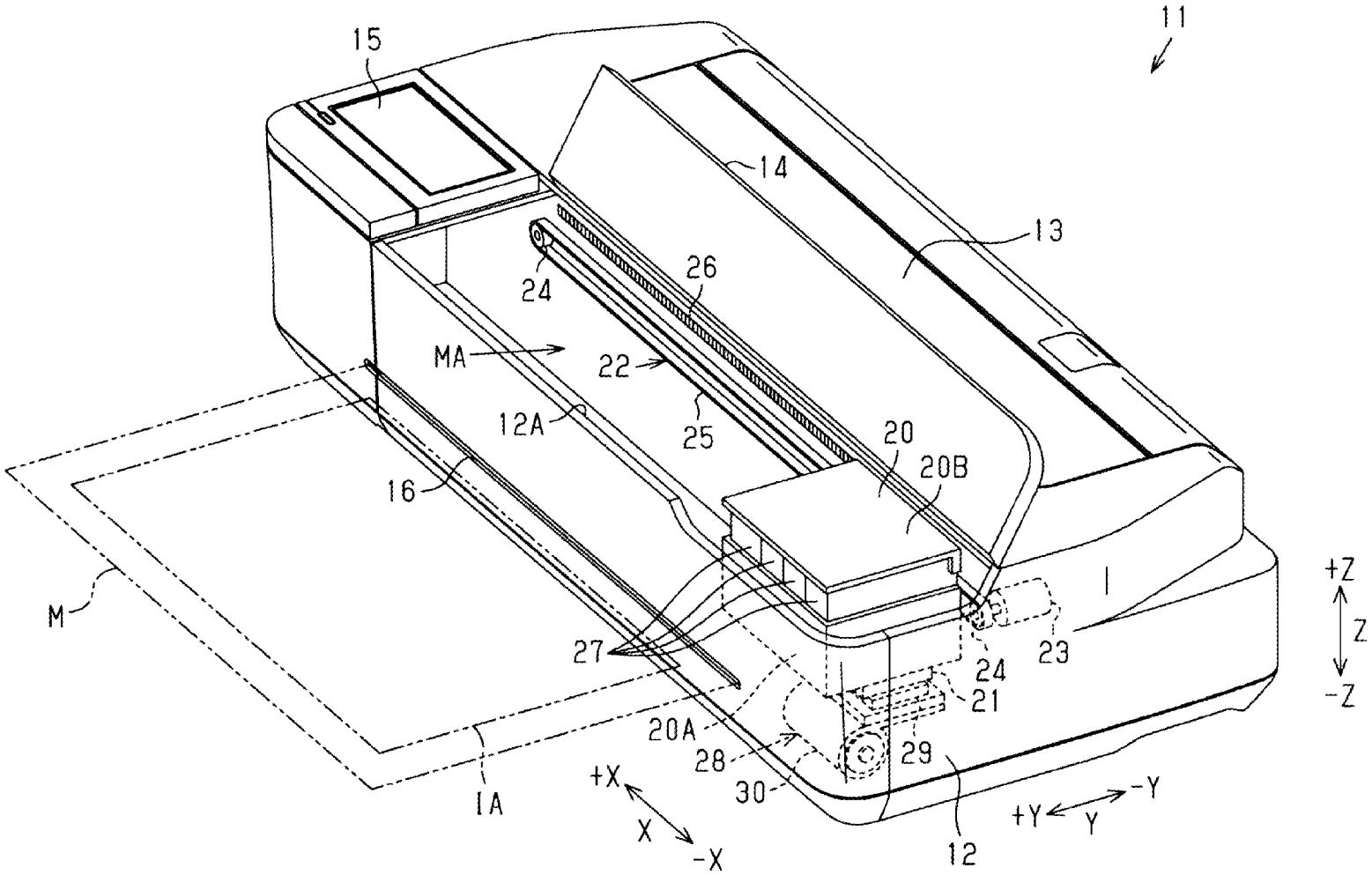
FIG. 2 is a perspective view showing the state in which a maintenance cover of the liquid discharge device is opened.

As shown in FIG. 2, the maintenance cover 14 can be opened and closed around the rear end part as an axis. When opening the maintenance cover 14, the carriage 20 and a moving area MA of the carriage 20 are exposed from an opening 12A disposed in the upper surface of the housing 12. Further, a part of a moving mechanism 22 for moving the carriage 20 in the X-axis direction is also exposed from the opening 12A. The moving mechanism 22 is constituted by a carriage motor 23, a pair of pulleys 24, a timing belt 25 and so on, wherein the carriage motor 23 is a power source of the carriage 20, the timing belt 25 is wound around the pair of pulleys 24, and a part of the timing belt 25 is fixed to the carriage 20. By the carriage motor 23 being driven in forward and reverse directions, the carriage 20 reciprocates in the X-axis direction in the moving area MA, and the liquid is discharged from the discharge head 21 in the moving process to thereby print the medium M. Further, a first encoder 26 formed of a linear encoder is disposed so as to extend along the moving path of the carriage 20. Speed control and position control of the carriage 20 are performed based on a pulse signal output from the first encoder 26.

On the carriage 20, there is detachably mounted a liquid cartridge 27 as an example of the liquid container in which the liquid such as ink to be supplied to the discharge head 21 is contained. The carriage 20 has the plurality of liquid cartridges 27 and the discharge head 21 mounted thereon, and moves in the X-axis direction. The liquid cartridges 27 are mounted at an upper position of the discharge head 21 in the carriage 20. The carriage 20 has a main body 20A and a cover 20B wherein the main body 20A is capable of housing the plurality of liquid cartridges 27, and the cover 20B covers the plurality of liquid cartridges 27 housed in the main body 20A from above. There is mounted the plurality of liquid cartridges 27 containing a plurality of colors of ink including, for example, cyan, magenta, yellow and black, respectively. It is also possible to adopt a configuration in which there is mounted a single liquid cartridge 27 for a single color of, for example, black. It should be noted that the liquid container is not limited to the liquid cartridge 27, but can also be a tank or an adapter which is mounted on the carriage 20, and in which the liquid is contained.

When printing is not performed, the carriage 20 waits at a home position HP shown in FIG. 2. Below the carriage 20 located at the home position HP, there is disposed a maintenance device 28 for performing maintenance on the discharge head 21. The maintenance device 28 is provided with a cap 29, a pump 30, a wiper 31 shown in FIG. 6 and so on. The cap 29 is disposed outside the range in which the discharge head 21 moves while discharging the liquid on the medium M when the discharge head 21 moves in the X-axis direction together with the carriage 20 in the moving area MA of the carriage 20. In other words, in the X-axis direction, with respect to the range in which the discharge head 21 moves while discharging the liquid on the medium M, the cap 29 is disposed outside the boundary of that range. When the carriage 20 waits at the home position HP, the discharge head 21 is capped with the cap 29 having contact with the discharge head 21. Due to the capping, the ink inside a nozzle of the discharge head 21 is prevented from increasing in viscosity or drying.

Figure 3:
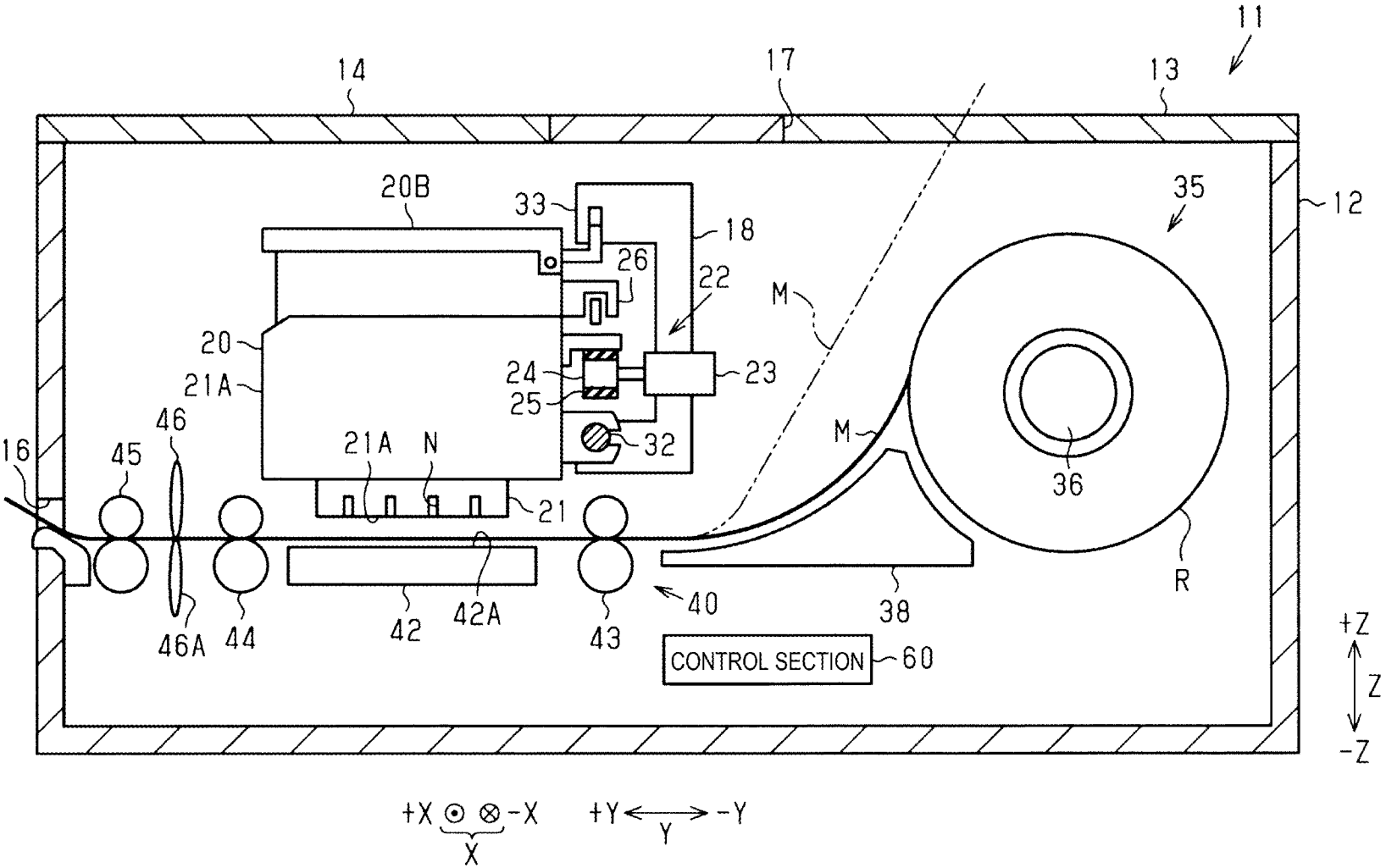
FIG. 3 is a schematic cross-sectional side view of the liquid discharge device broken along the line 3-3 in FIG. 1.

As shown in FIG. 3, the liquid discharge device 11 is provided with a guide shaft 32 extending in the X-axis direction inside the housing 12. The guide shaft 32 is bridged in the state of being supported by a frame 18 at a predetermined height position in the Z-axis direction inside the housing 12. In the present embodiment, there is provided a rail section 33 extending in the X-axis direction at a height position above the guide shaft 32. The rail section 33 is formed by performing a bending work on a part of the frame 18, and functions as a support shaft together with the guide shaft 32. The carriage 20 is arranged to be able to move in the X-axis direction as an extending direction of the guide shaft 32 while being guided by the guide shaft 32 and the rail section 33. The discharge head 21 is supported by the carriage 20, and reciprocates in the X-axis direction together with the carriage 20. The discharge head 21 has a nozzle surface 21A on which nozzles N open. Nozzles N is for discharging the liquid such as the ink. It should be noted that although four nozzles N are schematically illustrated in FIG. 3, a predetermined number of nozzles N in a range of 100 through 500 are disposed in, for example, the Y-axis direction.

Further, the liquid discharge device 11 is provided with the moving mechanism 22 for moving the carriage 20. The moving mechanism 22 is constituted by the carriage motor 23, the timing belt 25 and so on besides the guide shaft 32 and the rail section 33 for supporting the carriage 20, wherein the carriage motor 23 is the power source of the carriage 20, and the timing belt 25 is wound around the pulleys 24 rotating the power of the carriage motor 23. The carriage 20 is fixed to a part of the timing belt 25, and is reciprocated in the X-axis direction by the carriage motor 23 being driven in the forward and reverse directions. Further, the liquid discharge device 11 is provided with the first encoder 26 for detecting a moving position in the X-axis direction of the carriage 20.

The liquid discharge device 11 is provided with a feed section 35 for feeding the medium M. The feed section 35 is provided with a feed shaft 36 which can install a roll body R obtained by rolling medium M in a layered manner to form a cylindrical shape, and can rotate. A feed motor 37 shown in FIG. 13 as a power source of the feed shaft 36 is driven, and thus the roll body R rotates in the counterclockwise direction in FIG. 3 together with the feed shaft 36 to thereby feed the medium M. The medium M fed from the roll body R is, for example, a continuous form. Further, the feed section 35 is capable of supplying the medium M formed of, for example, a cut form via a paper inlet 17 as indicated by a dashed-two dotted line in FIG. 2.

Further, as shown in FIG. 3, the liquid discharge device 11 is provided with a guide member 38 for guiding the medium M fed from the feed section 35, and a conveying section 40 for conveying the medium M guided by the guide member 38. The conveying section 40 conveys the medium M in at least the Y-axis direction as an example of the second axis direction as a direction crossing the X-axis direction. The conveying section 40 uses a conveying motor 41 shown in FIG. 13 as a power source. Further, the liquid discharge device 11 is provided with a support stage 42 for supporting the medium M conveyed by the conveying section 40. An upper surface of the support stage 42 forms a mounting surface 42A on which the medium M is mounted. The conveying section 40 conveys the medium M in a direction crossing the X-axis direction of the discharge head 21. It should be noted that in the present embodiment, the X-axis direction coincides with the width direction of the medium M conveyed in the Y-axis direction.

The conveying section 40 is provided with a conveying roller pair 43, a relay roller pair 44 and an ejection roller pair 45, wherein the conveying roller pair 43 is located on the upstream of the discharge head 21, the relay roller pair 44 is located on the downstream of the discharge head 21, and the ejection roller pair 45 is located on the downstream of the relay roller pair 44 in the conveying path on which the medium M is conveyed. The conveying roller pair 43 rotates in the state of pinching the medium M to thereby convey the medium M toward the support stage 42. The relay roller pair 44 is disposed on the downstream of the support stage 42, and feeds the medium M toward the ejection roller pair 45. Between the conveying roller pair 43 and the ejection roller pair 45 in the conveying path, the medium M is conveyed in a direction of an axis included in a plane the normal direction of which coincides with the discharge direction of an ink droplet discharged from the discharge head 21. In the present embodiment, the discharge direction of the ink droplet is the Z-axis direction, and the conveying direction of the medium M is perpendicular to the X-axis direction, and therefore, the conveying direction of the medium M between the conveying roller pair 43 and the ejection roller pair 45 in the conveying path is parallel to the Y-axis direction.

The discharge head 21 discharges the liquid to a part supported by the support stage 42 in the medium M to thereby print the image and so on. The discharge head 21 is mounted on the carriage 20 in the posture in which the nozzle surface 21A on which the nozzles N open is opposed to the mounting surface 42A of the support stage 42. The discharge head 21 is an inkjet head for performing a print processing of performing printing by discharging the liquid such as the ink on the medium M mounted on the mounting surface 42A while moving in the X-axis direction together with the carriage 20. The liquid discharge device 11 makes the ink droplets discharged by the discharge head 21 adhere to the medium M to thereby print an image formed of a dot group.

Further, the liquid discharge device 11 is provided with a cutting section 46 capable of cutting the medium M on which recording has been performed by the discharge head 21. The cutting section 46 has a pair of rotary blades 46A which can rotate. The pair of rotary blades 46A are disposed at a position where the medium M can be pinched from above and below. The cutting section 46 cuts the medium M supplied from the roll body R and having been printed into a desired length by moving in the X-axis direction while pinching the medium M from above and below and cutting the medium M with the rotary blades 46A. Due to the cutting section 46, the medium M having been printed is cut at the cutting position between parts nipped by the relay roller pair 44 and the ejection roller pair 45. When the medium M is the cut form supplied from the paper inlet 17, the cutting section 46 is not driven. The ejection roller pair 45 rotates in the state of pinching the medium M to thereby eject the medium M from the outlet 16. The discharge head 21, the guide member 38, the conveying section 40, the support stage 42 and the cutting section 46 are housed in the housing 12. Further, inside the housing 12, there is disposed a control section 60 for controlling the liquid discharge device 11.

Figure 4:
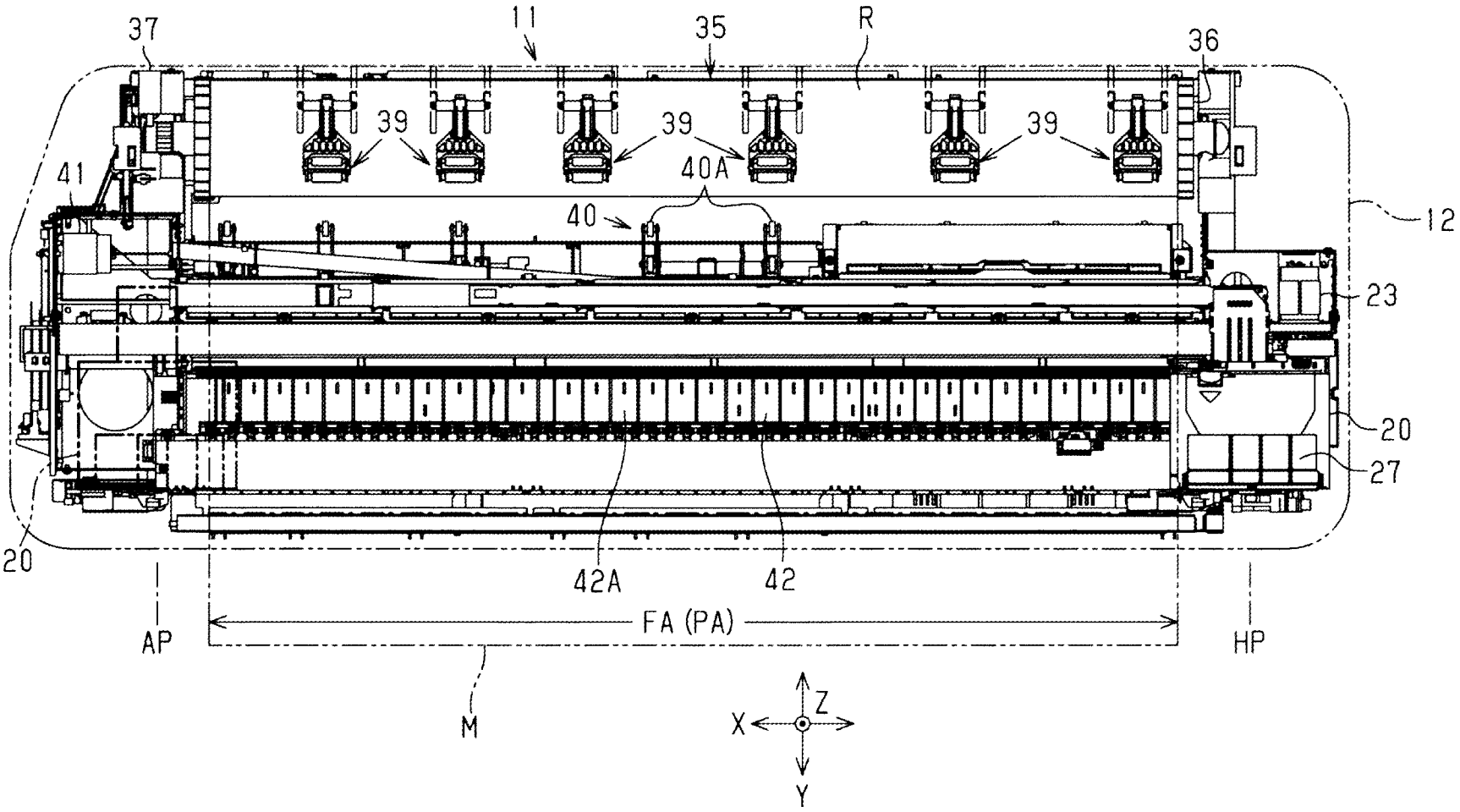
FIG. 4 is a plan view showing the inside of the liquid discharge device when a carriage is located at a home position.

As shown in FIG. 4, the carriage 20 waits at the home position HP shown in FIG. 4 and set in one end part in the X-axis direction in a scanning range of the carriage 20 when printing is not performed. The carriage 20 can move in a range of the moving area MA from the home position indicated by the solid lines in FIG. 4 to an anti-home position indicated by the dashed-two dotted lines in FIG. 4. In the housing 12, there is disposed the support stage 42 at a position corresponding to an area below the moving path of the carriage 20. Due to the rotational drive of the feed shaft 36 by the feed motor 37, the feed section 35 feeds the medium M from the roll body R installed in the feed shaft 36 toward the downstream in the conveying path. The roll body R is pressed at a plurality of places by a plurality of pressing rollers 39 disposed along the X-axis direction from above the outer circumferential surface of the roll body R. Further, at positions between the feed section 35 and the support stage 42 in the conveying path, there is disposed a plurality of pressing rollers 40A constituting a part of the conveying section 40. The medium M having been fed from the roll body R is supplied to an area above the mounting surface 42A of the support stage 42 by the conveying section 40 driven by the power of the conveying motor 41 while being guided by the rollers 39, 40A. The medium M is conveyed within a range of the conveying area FA in which the medium M can be conveyed in the X-axis direction. Further, the carriage 20 reciprocates in the X-axis direction within a range of a print processing area PA in which the discharge head 21 can discharge the liquid by the carriage motor 23 driving when printing is performed. The print processing area PA is included in the moving area MA which is an area between the home position HP and the anti-home position AP. When the carriage 20 is located at the home position HP, the discharge head 21 is located outside the conveying area FA and the print processing area PA in the X-axis direction.

Here, the conveying area FA denotes the area of the maximum range in which the medium M is conveyed, and corresponds to an area in which the medium M having the maximum width is conveyed. Further, the print processing area PA is a print range in which printing is performed on the medium M having the maximum width, and corresponds to the print range when performing margin-less printing on the medium M having the maximum width. It should be noted that the conveying area FA and the print processing area PA are substantially the same in size in the X-axis direction in the present embodiment, but in a model compatible with protrusion printing, the print processing area PA is slightly longer than the conveying area FA as much as an amount corresponding to the protrusion amount in a precise sense.

Figure 5:
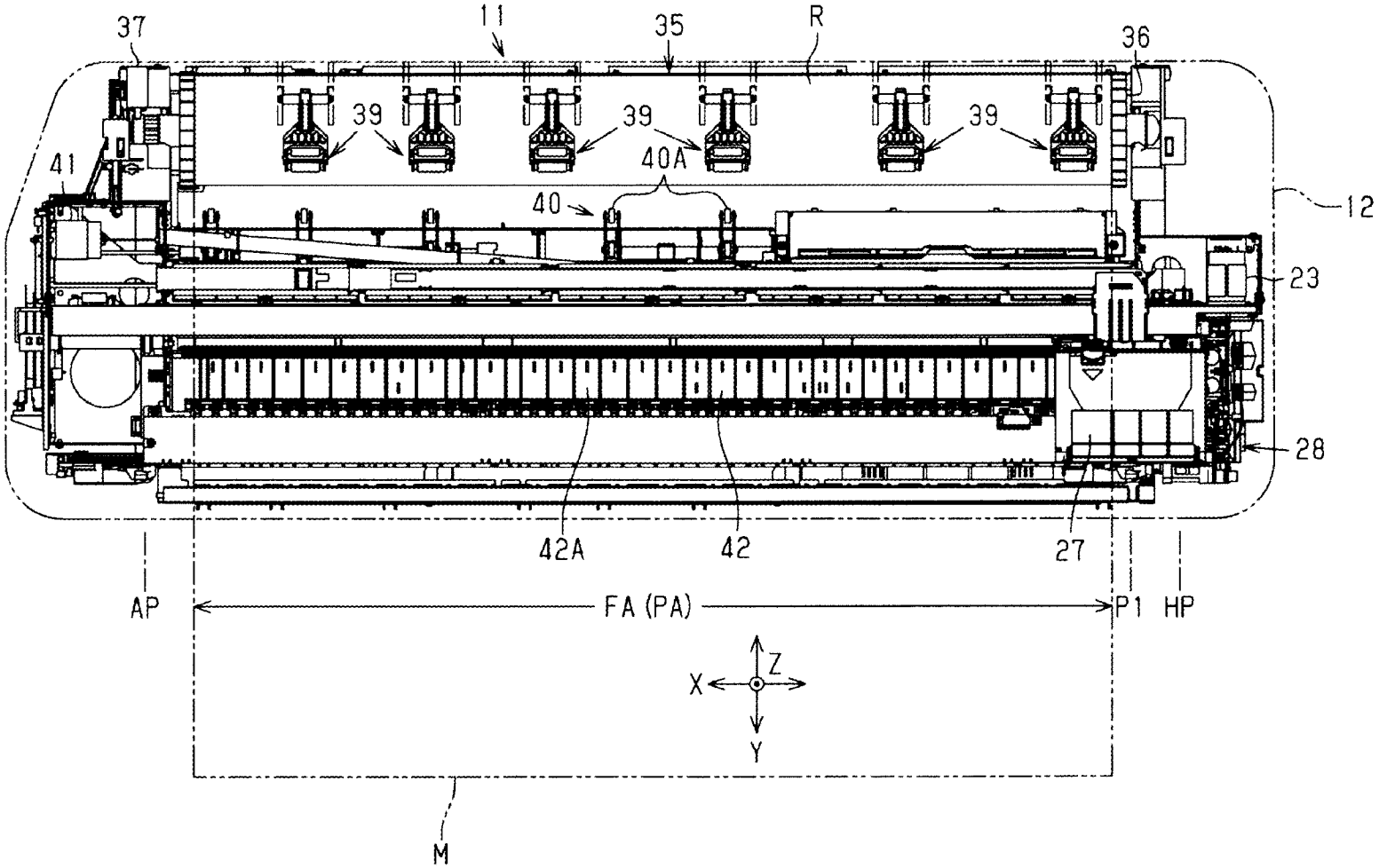
FIG. 5 is a plan view showing the inside of the liquid discharge device when the carriage is located at a first position where cartridge replacement is performed.

FIG. 5 shows the state in which the carriage 20 is disposed at the first position P1 when replacing the liquid cartridge 27. In the present embodiment, the first position P1 is set to a position where the nozzle surface 21A is located at a side end at the home position HP side of the conveying area FA of the medium M, namely located between a side end M1 on the home position HP side of the medium M having the maximum width conveyed and the home position HP, when the carriage 20 is located at the first position P1. The first position P1 can also be a position between a side end at the home position HP side of the print processing area PA, namely a side end at the home position HP side of the print processing area PA as an area where the margin-less printing is performed on the medium M having the maximum width conveyed, and the home position HP.

Figure 6:
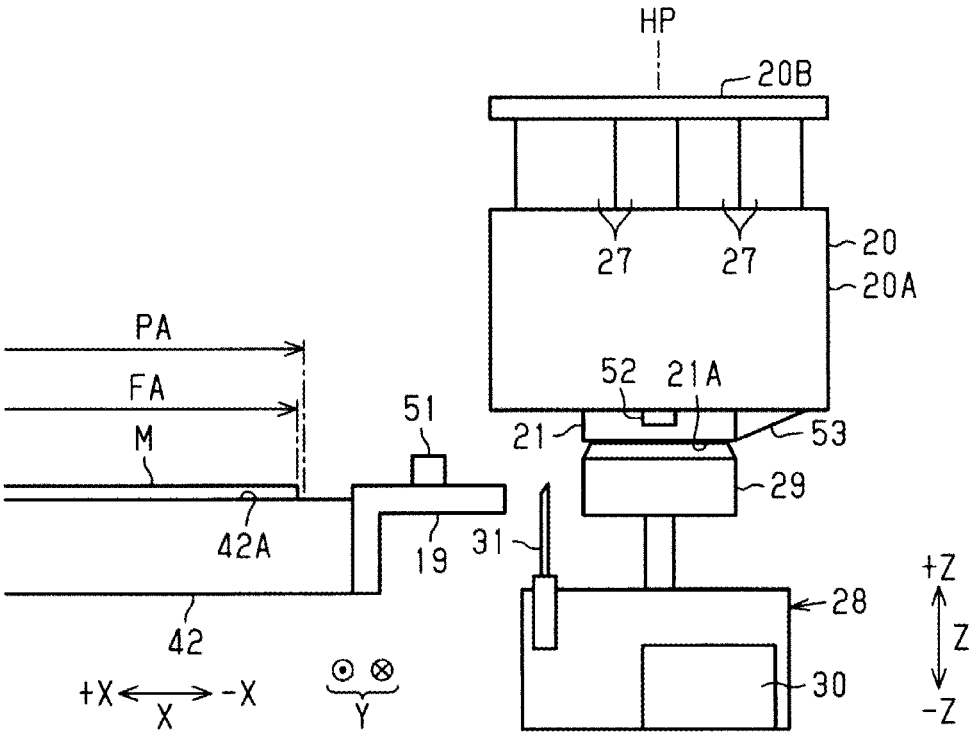
FIG. 6 is a schematic front view when the carriage is located at the home position.

As shown in FIG. 6, at a lower position opposed to the carriage 20 located at the home position HP, there is disposed the maintenance device 28. The maintenance device 28 is provided with the cap 29 at the position opposed to the discharge head 21 disposed at the home position HP. The cap 29 can move up and down, and moves in a vertical direction Z between an evacuation position shown in FIG. 7 and a capping position shown in FIG. 6. When the carriage 20 waits at the home position HP, the cap 29 moves up to have contact with the nozzle surface 21A to cap the discharge head 21.

Further, the maintenance device 28 is provided with the pump 30 and the wiper 31. The wiper 31 is located on the print processing area PA side of the cap 29. The pump 30 is, for example, a suction pump, and is driven in the state in which the cap 29 shown in FIG. 6 has contact with the nozzle surface 21A to cap the discharge head 21 to thereby eject the air in the cap 29. The maintenance device 28 provides the closed space surrounded by the nozzle surface 21A and the cap with negative pressure to thereby perform suction cleaning for forcibly performing the suction ejection of the liquid from the nozzles N. Cleaning is not limited to the suction cleaning, but can also be pressure cleaning for forcibly ejecting the liquid from the nozzles N by pressurizing the liquid of the liquid supply source such as the liquid cartridge 27 or the like with a pressurizing pump from the upstream of the liquid flow channel in the discharge head 21. The cleaning is performed periodically or irregularly, and in addition, when replacing the liquid cartridge 27. This is because bubbles are mixed in the liquid flow channel on the carriage 20 side in some cases when replacing the liquid cartridge 27. Further, since the liquid cartridge 27 is pushed into the carriage 20 when mounting the liquid cartridge 27 to be replaced with, when the carriage 20 deforms due to the pushing force on that occasion, and thus the liquid flow channel is pressurized, the liquid is leaked from the nozzles N in some cases. The liquid leaked from the nozzles N adheres to the nozzle surface 21A, or drops as a droplet. The liquid having adhered to the nozzle surface 21A has contact with the droplet discharged from the nozzle N to become a cause of the flight deflection of the droplet. Therefore, after replacing the liquid cartridge 27, there are performed the cleaning and wiping for wiping the nozzle surface 21A with the wiper 31.

Figure 10:
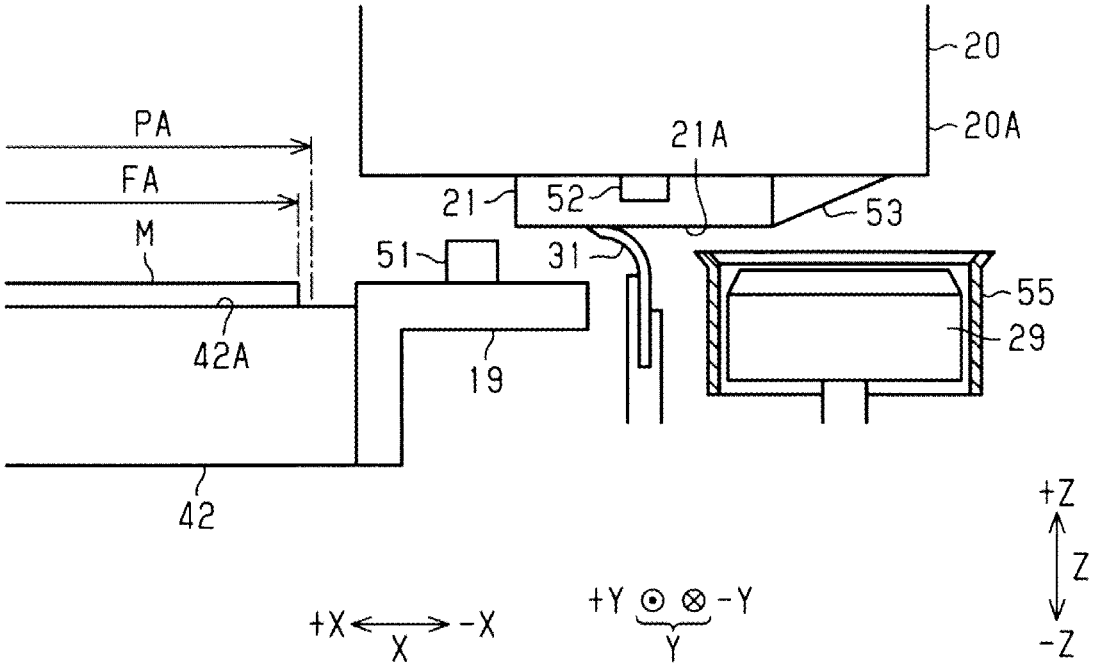
FIG. 10 is a schematic front view showing a wiping operation to the discharge head.

The wiper 31 provided to the maintenance device 28 is configured to be able to move up and down independently of the cap 29. The wiper 31 is arranged to be able to move in the vertical direction Z to the evacuation position shown in FIG. 6 and FIG. 7, and the wiping position shown in FIG. 11. As shown in FIG. 10, the wiper 31 wipes the nozzle surface 21A when the carriage 20 moves on one side (the +X direction) in the X-axis direction in the state in which the wiper 31 is disposed at the wiping position.

Figure 7:
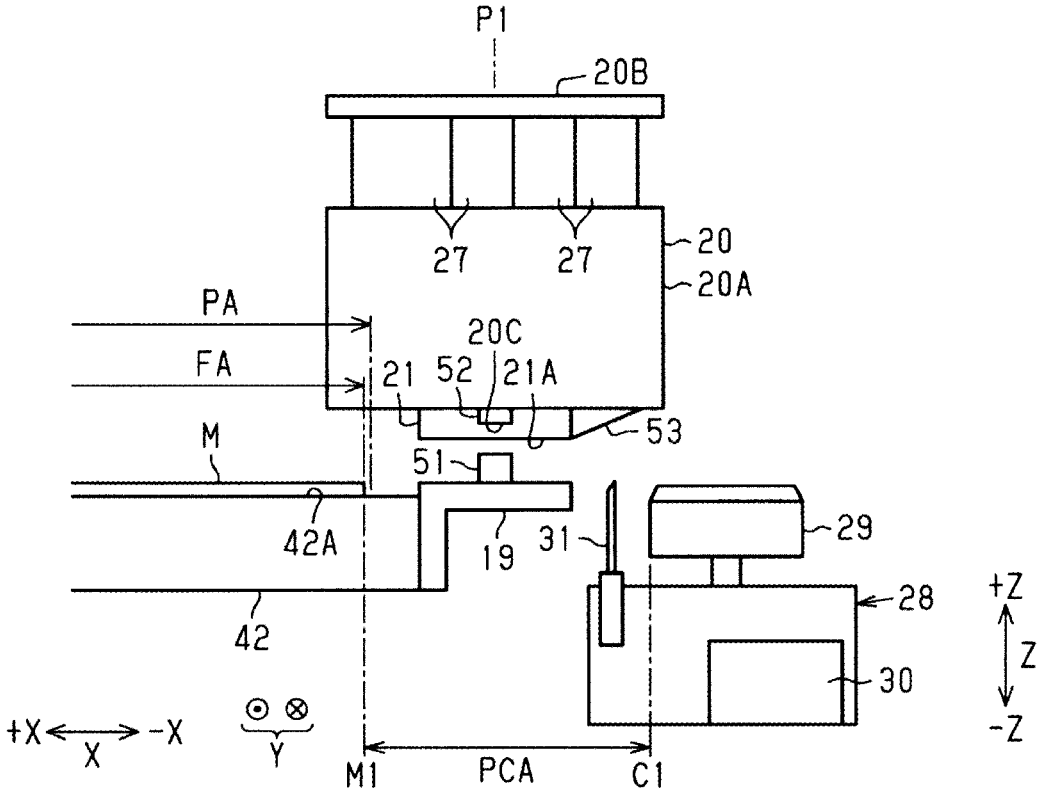
FIG. 7 is a schematic front view when the carriage is located at the first position.

FIG. 7 shows the state in which the carriage 20 is disposed at the first position P1 where the cartridge replacement is performed. As shown in FIG. 7, the first position P1 is set to the position of the carriage 20 where the nozzle surface 21A is opposed to an area PCA between the side end M1 on the cap 29 side in the conveying area FA of the medium M and a side end C1 on the conveying area FA side in the cap 29 in the X-axis direction. In other words, the first position P1 is set to the position of the carriage 20 where the nozzle surface 21A is opposed to the area PCA between the conveying area FA and the cap 29. Further, the first position P1 of the present embodiment is also the position of the carriage 20 where the nozzle surface 21A is opposed to the area PCA between the print processing area PA and the cap 29. When the carriage 20 is placed at the first position P1, the nozzle surface 21A does not overlap the medium M in the vertical direction Z irrespective of the size of the medium M. Further, when the carriage 20 is placed at the first position P1, the nozzle surface 21A does not overlap the cap 29 in the vertical direction Z.

Figure 11:
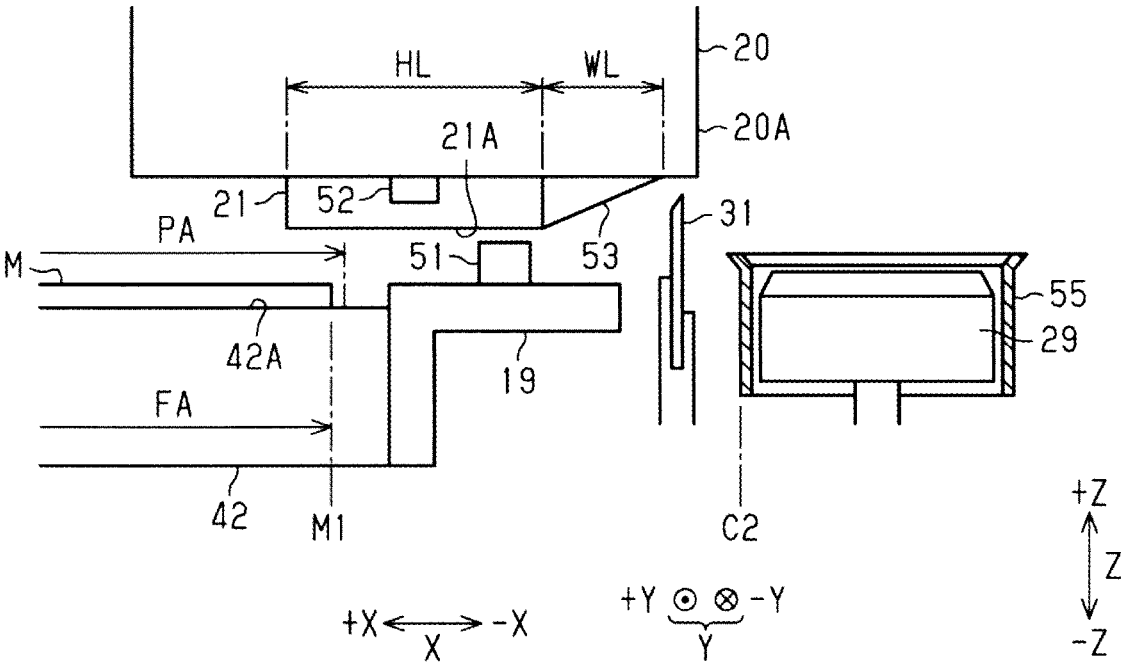
FIG. 11 is a schematic front view showing a position of the discharge head when the wiping operation is completed.

Further, as shown in FIG. 10 and FIG. 11, the cap 29 is provided with a head guide member 55 throughout an upper side and the periphery of the cap 29. The head guide member 55 can move up and down together with the cap 29, and induces the discharge head 21 to the cap 29 in the process of moving upward. In the configuration having the head guide member 55, it is preferable for the first position P1 to be set to the position of the carriage 20 where the nozzle surface 21A is opposed to an area between the side end M1 of the conveying area FA and a side end C2 on the conveying area FA side of the head guide member 55 in the X-axis direction.

Here, it is required for the first position P1 where the liquid cartridge 27 is replaced that the nozzle surface 21A is shifted outside at least the conveying area FA of the medium M toward the cap 29. Further, it is also possible for the nozzle surface 21A to be shifted outside the print processing area PA toward the cap 29 side. Further, it is also possible for the nozzle surface 21A to be shifted outside the cap 29, which is not preferable since the device size in the X-axis direction of the liquid discharge device 11 increases. Further, when the discharge head 21 is located at a position where the discharge head 21 overlaps the cap 29, the discharge head 21 has contact with the cap 29 to apply a load to the cap 29 when the discharge head 21 is displaced downward due to the pushing force when replacing the cartridge, which is not preferable. Therefore, it is preferable for the first position P1 to be the position of the carriage 20 where the nozzle surface 21A can be opposed to the area PCA which is an area outside the side end M1 on the cap 29 side of the medium M having the maximum width, namely an area outside the conveying area FA, and which does not overlap the cap 29 and located inner side of the cap 29. Therefore, it is preferable for the first position P1 to be the position which fulfills the condition that the whole of the nozzle surface 21A fits into the area PCA between the side end M1 on the cap side in the conveying area FA of the medium M and the side end C1 on the conveying area FA side of the cap 29 in the X-axis direction.

Figure 9:
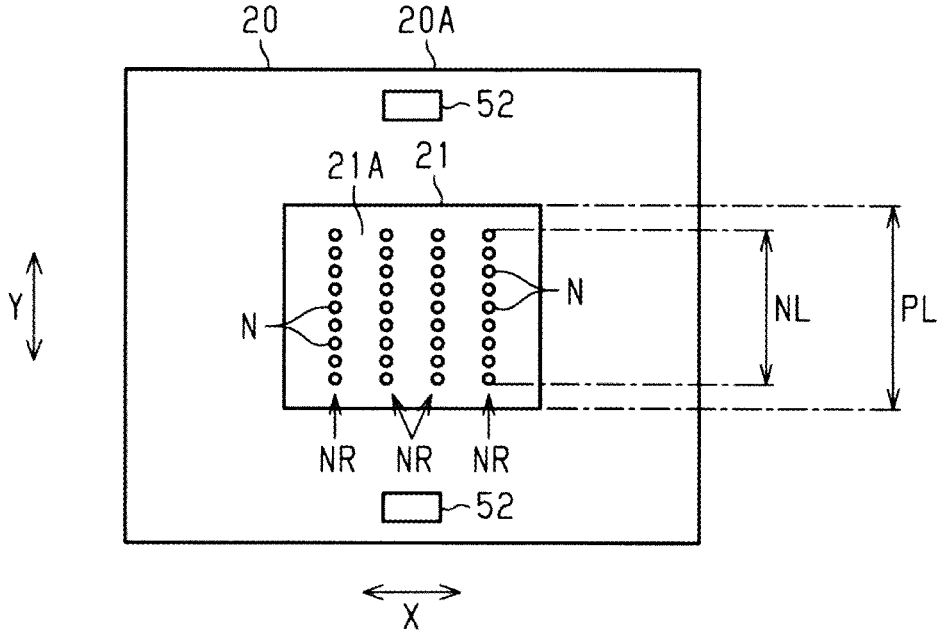
FIG. 9 is a schematic bottom view showing a nozzle surface of a discharge head.

As shown in FIG. 7, the bottom surface of the carriage 20 resting at the first position P1 is opposed to a bottom frame 19. The liquid discharge device 11 has first projections 51 as an example of a projection capable of having contact with a carriage surface 20C when the nozzle surface 21A is located at the first position P1. The carriage surface 20C is a surface, of the carriage 20, on the side in the direction (−Z direction) in which the liquid is discharged. In the other words, the carriage surface 20C is a surface configured to face to the medium M conveyed. The first projections 51 project from an upper surface of the bottom frame 19 upward in the vertical direction Z. When the carriage surface 20C of the carriage 20 and the projections 51 have contact with each other, the nozzle surface 21A and the upper surface of the bottom frame 19 located at the position opposed to the nozzle surface 21A are separated from each other. In the present embodiment, in a part of the bottom surface of the carriage 20 other than the discharge head 21, there are formed second projections 52 projecting downward at positions opposed to the first projections 51 in the state in which the carriage 20 stops at the first position P1. As shown in FIG. 9, the second projections 52 are disposed on the bottom surface of the carriage 20 at positions on both sides across the discharge head 21 in the Y-axis direction from each other as a pair of projections.

Figure 8:
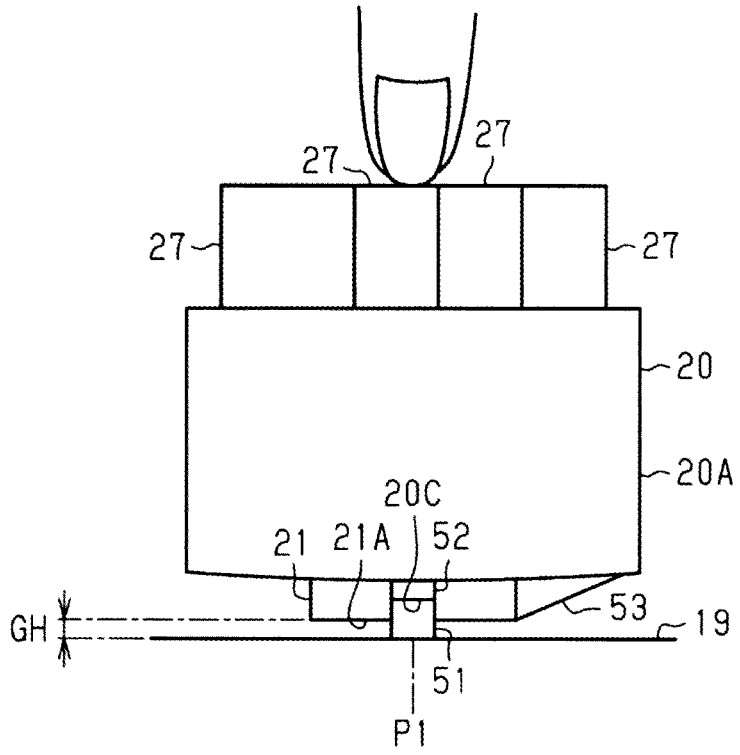
FIG. 8 is a schematic front view when mounting a liquid cartridge.

As shown in FIG. 8, when the liquid cartridge 27 which is new or to which the liquid has been injected is pushed in the carriage 20 by the user when mounting the liquid cartridge 27 on the carriage 20 for replacing the liquid cartridge, a component made of synthetic resin such as the carriage 20 deforms for a moment due to the pushing force. On this occasion, the nozzle surface 21A of the discharge head 21 moves down for a moment, but the first projections 51 and the carriage surface 20C have contact with each other to prevent the nozzle surface 21A from further moving downward. In the present embodiment, the first projections 51 and the second projections 52 have contact with each other to prevent the nozzle surface 21A from further moving downward. As a result, a gap GH is kept between the nozzle surface 21A and the bottom frame 19, and thus, the nozzle surface 21A and the bottom frame 19 are prevented from having contact with each other. In the present embodiment, since the second projections 52 are formed on the carriage 20 side, as shown in FIG. 8, a lower end surface of each of the second projections 52 forms the carriage surface 20C. By forming the second projections 52 on the carriage 20 side, it is possible to suppress the projection height of the first projections 51 on the bottom frame 19 side to a low level. It should be noted that it is also possible to adopt a configuration in which the second projections 52 are eliminated, and the first projections 51 has direct contact with the carriage surface formed of the bottom surface of the carriage 20.

As shown in FIG. 9, on the nozzle surface 21A of the discharge head 21, there are disposed the same number of nozzle columns NR as the number of the liquid cartridges 27 to be mounted on the carriage 20. The nozzle columns NR are each formed of a group of M nozzles N arranged at a predetermined nozzle pitch in the Y-axis direction. It should be noted that M is a predetermined value within a range of, for example, 100 through 500. Here, the size in the Y-axis direction of the range in which the plurality of nozzles N constituting the nozzle column NR is defined as a nozzle column dimension NL, and the size in the Y-axis direction of the nozzle surface 21A is defined as a nozzle surface dimension PL.

As shown in FIG. 10, the nozzle surface 21A is wiped by the wiper 31 disposed at the wiping position in the process in which the carriage 20 moves from the home position HP toward the conveying area FA. On this occasion, the wiper 31 made of an elastic material such as elastomer or rubber wipes the nozzle surface 21A in the state of having contact with the nozzle surface 21A and thus curved as shown in FIG. 10. There is a possibility that the liquid scraped by the wiper 31 flies on the periphery, and the periphery and the medium M are made dirty when the wiper 31 instantaneously stretches from the state of being curved to restore to the original state when wiping has been completed and then the wiper 31 disengages from the nozzle surface 21A. Therefore, in order to gently restore the wiper 31 from the state of being curved during the wiping to the state of being stretched, the carriage 20 is provided with a slope 53 at an adjacent position on the downstream in the wiping direction of the wiper 31 in the discharge head 21. The slope 53 is tilted in a direction in which the position in the vertical direction Z gradually rises as the distance from the nozzle surface 21A increases.

Here, in order only to simply wipe the nozzle surface 21A, it is sufficient to move the carriage 20 to the print processing area PA side of the wiper 31 as much as the width dimension of the nozzle surface 21A when performing wiping. However, when the carriage 20 having the slope 53 is used, it is necessary to move the carriage 20 excessively as much as extra length corresponding to the dimension in the X-axis direction of the slope 53 toward the print processing area PA. In the case of the present embodiment, when the carriage 20 is moved toward the print processing area PA to the position necessary for the wiping, it results in that the carriage 20 is moved to the position where the nozzle surface 21A is opposed to the medium M as shown in FIG. 11.

As shown in FIG. 11, in order to use the slope 53 when performing the wiping with the wiper 31, it is necessary to ensure the wiping stroke no smaller than the dimension obtained by adding the slope dimension WL as the dimension in the X-axis direction of the slope 53 to the head width HL as the dimension in the X-axis direction of the discharge head 21. When the wiper 31 performs the wiping operation with the wiping stroke, there is achieved the positional relationship in which the discharge head 21 and the medium M are opposed to each other in the vertical direction Z when the discharge head 21 has moved to the wiping completion position. In other words, a part on the side end M1 side of the medium M is opposed in the vertical direction Z to the nozzle surface 21A.

Figure 12:
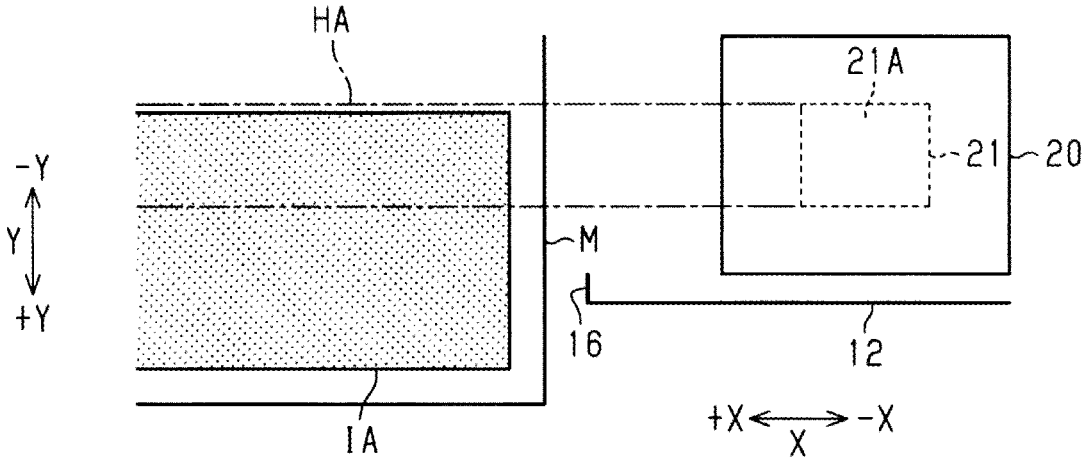
FIG. 12 is a schematic plan view showing the discharge head and a medium when printing is stopped due to liquid end.

On this occasion, when the printed area IA on which the liquid discharged from the discharge head 21 adheres in the medium M swells with the liquid and bulges, there is a concern that the nozzle surface 21A scrapes against the printed area IA on the medium M in the process in which the discharge head 21 moves to the wiping completion position shown in FIG. 11. Further, as shown in FIG. 12, when the printed area IA of the medium M is located in a nozzle surface opposed area HA opposed to the nozzle surface 21A, there is a concern that the nozzle surface 21A having moved to the wiping completion position has contact with a bulging part of the medium M due to cockling which is a phenomenon that the medium M having absorbed the ink swells and thus waves when performing wiping. When the nozzle surface 21A has contact with the printed area IA of the medium M, there is a concern that the nozzle surface 21A scrapes against the print surface to degrade the print quality, or there occurs a discharge failure that the liquid meniscus having just been adjusted of the nozzles N of the nozzle surface 21A immediately after cleaning is broken to make it unachievable to appropriately discharge the droplet.

Therefore, in the present embodiment, when replacing the cartridge, it is arranged that the medium M is evacuated along the Y-axis direction to a position where the discharge head 21 in the process of wiping and the printed area IA are not opposed to each other. In the other words, the control section 60 evacuates the printed area IA from the nozzle surface opposed area HA. Therefore, in the present embodiment, even the nozzle surface 21A is supposedly opposed to the medium M when performing wiping after cleaning, the nozzle surface 21A is opposed to the medium M in a part other than the printed area IA, the printed area IA being apt to bulge due to the cockling or the like, and the nozzle surface 21A is therefore prevented from having contact with the medium M.

Figure 13:
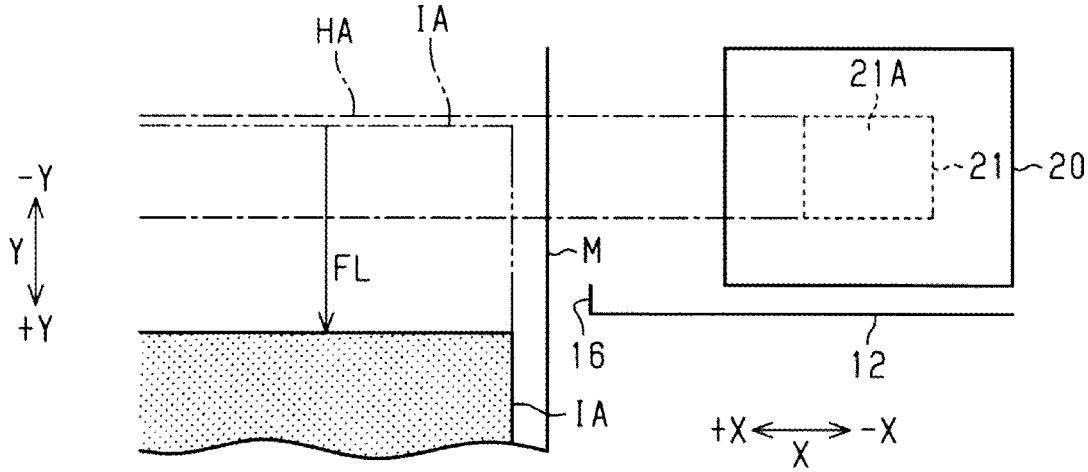
FIG. 13 is a schematic plan view showing an evacuation operation of the medium.
Figure 14:
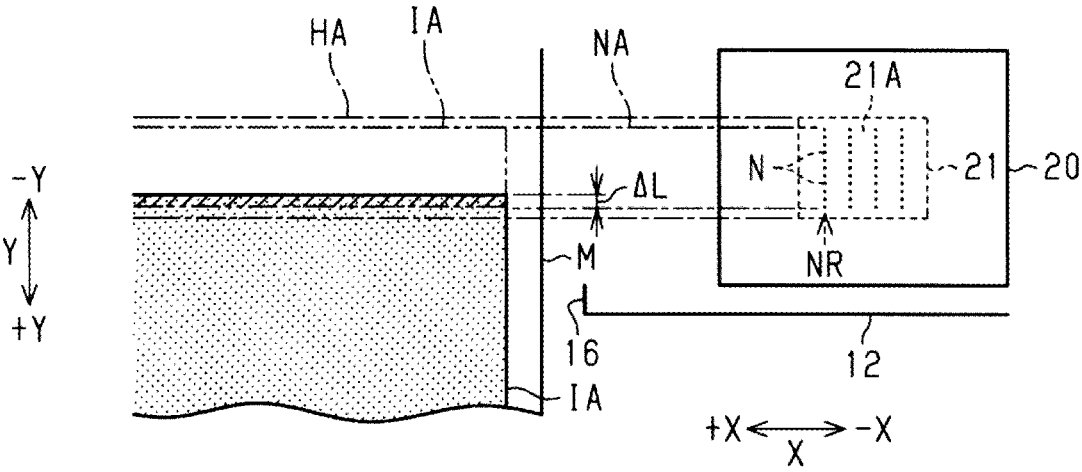
FIG. 14 is a schematic plan view showing a restoration position of the medium when resuming the printing.

FIG. 12 through FIG. 14 describe the operation performed when replacing the cartridge. When liquid end occurs, printing is aborted, and printing is stopped in the state shown in, for example, FIG. 12. On this occasion, a part of the printed area IA is located in the nozzle surface opposed area HA which can be opposed to the nozzle surface 21A of the discharge head 21. When the part of the printed area IA of the medium M is located in the nozzle surface opposed area HA, when the medium M bulges in the printed area IA part due to cockling or the like, there is a concern that the nozzle surface 21A and the printed area IA scrape against each other when the discharge head 21 moves to the wiping completion position.

Therefore, in the present embodiment, the printed area IA is evacuated in the Y-axis direction from the nozzle surface opposed area HA. In the present embodiment, the control section 60 moves the printed area IA attached with the ink to the downstream of the nozzle surface opposed area HA in the conveying path in the evacuation operation. In other words, due to the evacuation operation, the printed area IA attached with the ink moves to the +Y side in the Y-axis direction. On this occasion, the direction toward the +Y side corresponds to the direction toward an opposite side to the −Y side, where an area which has not yet been attached with the ink out of the medium M is located, from the nozzle surface opposed area HA. In other words, the printed area IA is moved to the opposite side to the area on which the liquid has not yet been discharged about the nozzle surface opposed area HA. It should be noted that it is also possible to evacuate the printed area IA toward the upstream in the conveying path, namely toward the −Y side providing the printed area IA is located within the range up to the position anterior to a part to be wound by the roll body R. When the printed area IA moves to the +Y side of the nozzle surface opposed area HA, the area which has not yet been attached with the ink out of the medium M is located in the nozzle surface opposed area HA. The area which has not yet been attached with the ink out of the medium M is hard to bulge compared to the area attached with the ink. Therefore, the possibility that the nozzle surface 21A and the printed area IA scrape against each other when the discharge head 21 has moved to the wiping completion position is further reduced.

When the replacement of the liquid cartridge 27 has been instructed, namely when the replacement of the liquid cartridge 27 is performed, the control section 60 performs the evacuation operation of conveying the medium M to evacuate the printed area IA attached with the ink discharged by the discharge head 21 out of the medium M. There is performed the evacuation operation of moving the medium M toward the downstream in the conveying path to evacuate the printed area IA on the medium M toward the +Y side from the nozzle surface opposed area HA opposed to the nozzle surface 21A. Here, in the evacuation operation, the conveying length of the medium M in the Y-axis direction is larger than the nozzle surface dimension PL (see FIG. 9) as the dimension in the Y-axis direction of the nozzle surface 21A. As a result, as shown in FIG. 13, the printed area IA of the medium M is evacuated to the outside of the nozzle surface opposed area HA in the Y-axis direction.

In particular in the present embodiment, as shown in FIG. 13, the control section 60 locates the printed area IA on which the liquid has been discharged outside the housing 12 from the outlet 16 in the evacuation operation. The conveying length FL (see FIG. 13) of the medium M conveyed in the evacuation operation is set to the value with which the whole of the printed area IA can be evacuated on the downstream in the conveying path of the outlet 16, namely outside the housing 12. Therefore, the printed area IA is ejected outside the housing 12 by the evacuation operation. Here, since the liquid such as the ink is discharged inside the housing 12, the inside of the housing 12 is higher in humidity compared to the outside of the housing 12. Therefore, by evacuating the printed area IA to the outside of the housing 12, drying of the ink in the printed area IA is facilitated compared to the case in which the printed area IA is located inside the housing 12.

The control section 60 evacuates the whole of the printed area IA to the outside of the nozzle surface opposed area HA in the present embodiment, but it is also possible to adopt a configuration in which the control section 60 evacuates at least an area on which the liquid has just been discharged out of the printed area IA to the outside of the nozzle surface opposed area HA. The "area on which the liquid has just been discharged" is an area located in the nozzle surface opposed area HA at the time point when printing is aborted shown in, for example, FIG. 12. The medium M is the easiest to swell immediately after the liquid is discharged, and has a high possibility of bulging. Therefore, according to this configuration, the possibility that the nozzle surface 21A and the medium M have contact with each other is reduced while suppressing the moving amount of the medium M compared to the configuration of evacuating the whole of the printed area IA to the outside of the nozzle surface opposed area HA.

Further, it is also possible to adopt a configuration in which the control section 60 moves the medium M toward the upstream in the conveying path instead of moving the medium M toward the downstream in the conveying path to thereby evacuate the whole of the printed area IA or at least the area on which the liquid has just been discharged outside the nozzle surface opposed area HA. According to this configuration, by ejecting the printed area IA, which should not be ejected outside the housing 12 from the outlet 16 in the normal printing, outside the housing 12, the possibility that the print quality is degraded due to some external factor is reduced.

Further, as shown in FIG. 14, when completion of the replacement of the liquid cartridge 27 has been detected after the evacuation operation of the medium M, the medium M is moved toward the upstream in the conveying path. In other words, the medium M is conveyed in the direction toward the −Y side opposite to the direction toward the +Y side which is the conveying direction of the medium M in the evacuation operation. The control section 60 conveys the medium M toward the −Y side as much as the conveying length corresponding to the conveying length FL of the conveyance of the medium M toward the +Y side in the evacuation operation in the Y-axis direction. As a result, the medium M is returned to the original conveyance position when the printing is aborted due to the liquid end. The control section 60 conveys the medium M in the direction toward the −Y side to return the medium M to the original conveyance position, then moves the carriage 20 from the first position P1 toward the print processing area PA and then discharges the ink from the nozzles N of the discharge head 21 on the medium M for resuming the printing.

In the present embodiment, as one of the operation related to the replacement of the liquid cartridge 27 by the user, there are performed the evacuation operation of evacuating the medium M to the outside of the nozzle surface opposed area HA, and the operation of returning the medium M to the original conveyance position when aborting the printing, but this is not a limitation. For example, when aborting the printing for a predetermined period due to the instruction of the user or the like, and then resuming the printing, it is possible to perform the operation of evacuating the medium M to the outside of the nozzle surface opposed area HA, and the operation of returning the medium M to the original conveyance position when aborting the printing.

The printing resumption position of the medium M is set in an area partially overlapping the printed area IA before the medium M evacuates, or set in an area adjacent to the upstream of the printed area IA. Therefore, printing after the replacement of the liquid cartridge is resumed from the area partially overlapping the printed area IA, or the area adjacent to the upstream of the printed area IA. It should be noted that in the former case, the dimension ΔL (FIG. 14) of a part overlapping in the Y-axis direction is preferably a value within a range of 1 through 3 dots in the unit of dot formed by discharging the liquid from the nozzle N. Thus, the areas IA printed before and after the abort of the printing are made to partially overlap each other to thereby make banding (stripe) and so on inconspicuous. It should be noted that the dimension ΔL is a dimension in the Y-axis direction of a part where a nozzle opposed area NA opposed to one column of nozzles N in the X-axis direction and the printed area IA overlap each other.

Figure 15:
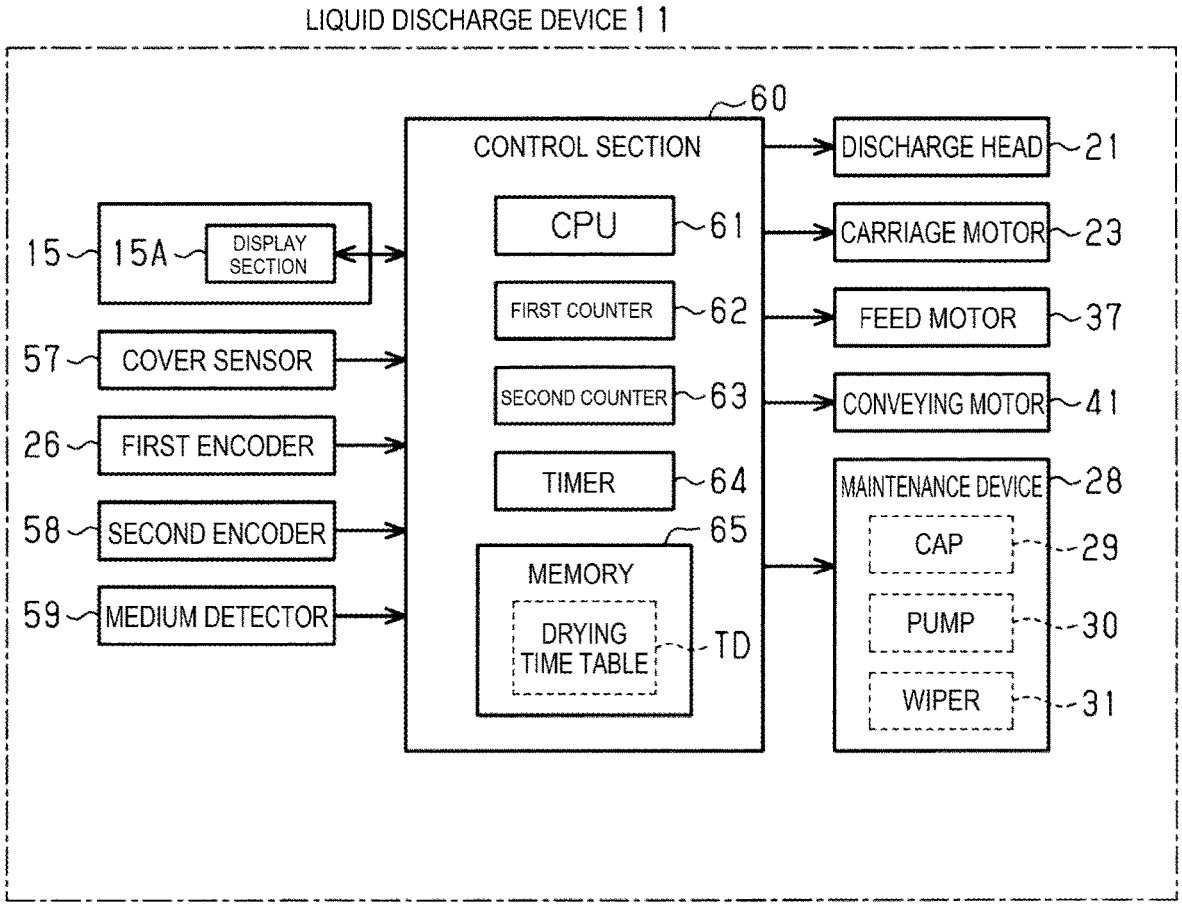
FIG. 15 is a block diagram showing an electrical configuration of the liquid discharge device.

Then, an electrical configuration of the liquid discharge device 11 will be described with reference to FIG. 15. As shown in FIG. 15, the liquid discharge device 11 prints an image based on print data received from a host device not shown on the medium M. The liquid discharge device 11 is provided with the control section 60 responsible for a variety of types of control including the moving control of the carriage 20. To the control section 60, there are electrically connected the discharge head 21, the carriage motor 23, the feed motor 37 and the conveying motor 41. Further, to the control section 60, there are connected the operation panel 15, a cover sensor 57, the first encoder 26, a second encoder 58 and a medium detector 59. The operation panel 15 is provided with a display section 15A.

The control section 60 controls the discharge head 21 based on the print data to thereby discharge an ink droplet from the nozzles N. Further, the control section 60 controls the carriage motor 23 to thereby perform the position control and the speed control of the carriage 20. When the control section 60 performs the forward drive of the carriage motor 23, the carriage 20 moves forward in the +X direction of getting away from the home position HP, and when the control section 60 performs the reverse drive of the carriage motor 23, the carriage 20 moves backward in the −X direction of getting closer to the home position HP. Further, the control section 60 controls the feed motor 37 to thereby drive the feed section 35, and thus feeds the medium M formed of a cut form via the paper inlet 17, or unwinds the roll body R to feed the medium M formed of the continuous medium. Further, the control section 60 controls the conveying motor 41 to thereby drive the conveying section 40, and thus conveys the medium M thus fed in the Y-axis direction due to the drive of the roller pairs 43 through 45.

The control section 60 displays a menu and a variety of messages on the display section 15A of the operation panel 15. The control section 60 manages the remaining amount of the liquid in the liquid cartridge 27, and informs the user of the fact that the remaining amount of the liquid reaches the liquid end by displaying the message representing the liquid end on the display section 15A when the remaining amount of the liquid has reached the liquid end.

The carriage 20 has terminals not shown on the mounting surface of the liquid cartridge 27. The liquid cartridge 27 has a storage element mounted thereon, and has terminals on a mounting target surface. When removing the liquid cartridge 27 from the carriage 20, the terminals on the both surfaces are separated from each other to get into an electrically non-contact state, and in contrast, when mounting the liquid cartridge 27 on the carriage 20, the terminals on the both surfaces are electrically connected. The control section 60 detects mounting and removal of the liquid cartridge 27 through the connection and disconnection between the terminals of the liquid cartridge 27 and the terminals of the carriage 20. Further, the control section 60 is capable of reading and writing the storage element via the connection between the terminals on the both sides in the state in which the liquid cartridge 27 is mounted on the carriage 20. The storage element of the liquid cartridge 27 stores liquid related information such as part number information, liquid color information, and liquid remaining-amount information. The control section 60 manages consumption of the liquid consumed in printing and so on by the liquid discharge device 11, and manages the current remaining amount of the liquid by subtracting the consumption of the liquid from the remaining-amount information retrieved from the storage element. The remaining amount of the liquid is retrieved from the storage element when powering on the liquid discharge device 11, and when powering off the liquid discharge device 11, the information of the remaining amount of the liquid having been measured up to that time is written to the storage element.

The control section 60 periodically determines whether or not the remaining amount of the liquid has reached the liquid end, and gives information of that fact when the liquid end has been reached. Further, when the user opens the maintenance cover 14 in the state in which a liquid end flag is set in a memory 65 after the control section 60 has detected the liquid end and gives the information of the liquid end, the control section 60 regards input of the detection signal from the cover sensor 57 which has detected the open of the maintenance cover 14 as issuance of the instruction of the replacement of the liquid cartridge 27.

Figure 16:
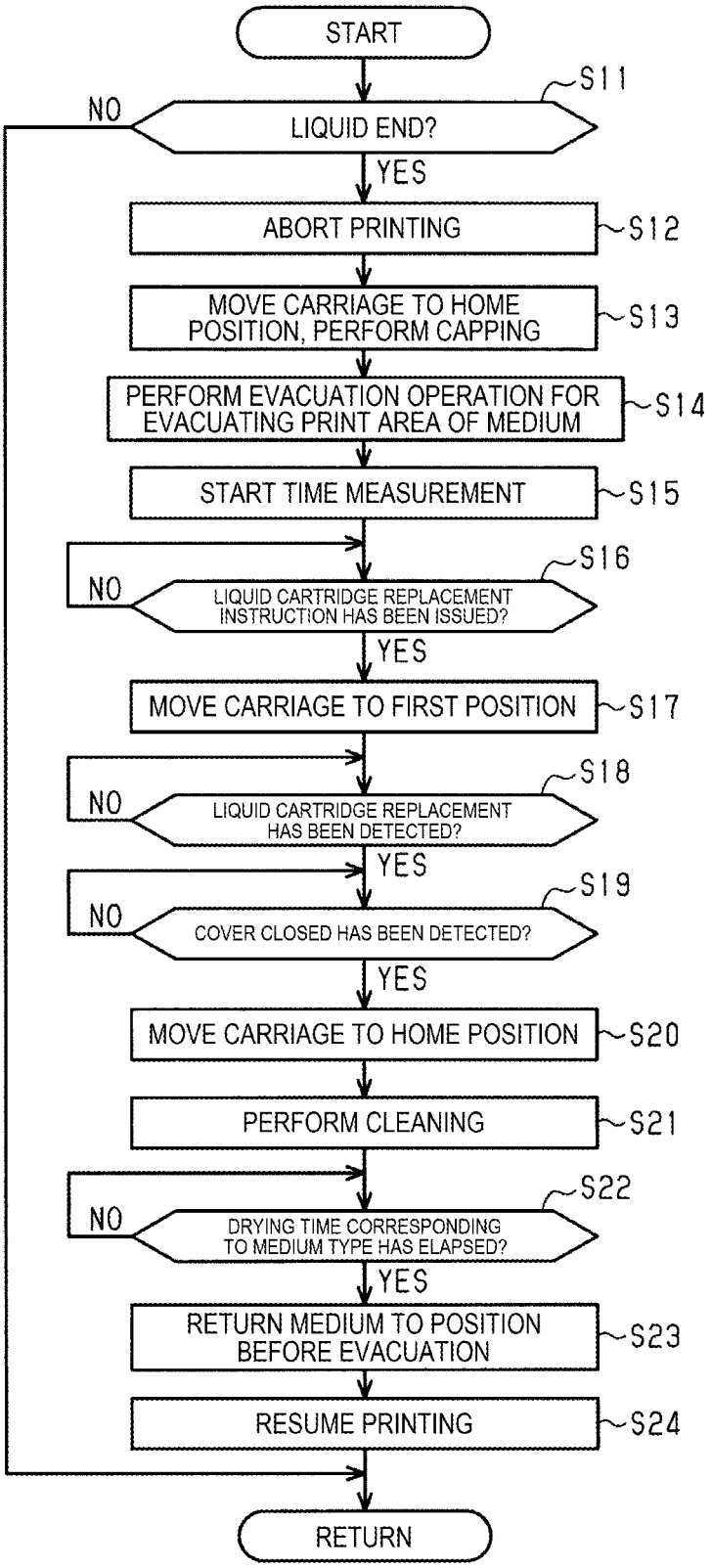
FIG. 16 is a flowchart showing cartridge replacement control.

The control section 60 is provided with a CPU 61 as a processor, a first counter 62, a second counter 63, a timer 64 and the memory 65. The memory 65 stores a variety of programs to be executed by the CPU 61. The programs include a program for controlling the cartridge replacement expressed by the flowchart in FIG. 16. The CPU 61 executes the program for controlling printing stored in the memory 65 to thereby perform a variety of types of printing control. Further, the CPU 61 executes the program expressed by the flowchart in FIG. 16 to thereby perform the control when replacing the cartridge. Here, the control when replacing the cartridge is the control for helping the replacement of the liquid cartridge 27 by the user, and at the same time suppressing degradation of the print quality due to the abort of printing when the cartridge replacement is performed in the process of the printing. The control when replacing the cartridge includes moving the carriage 20 to the first position P1 where the cartridge replacement is performed, the evacuation operation of the medium M, and so on.

The first counter 62 counts the number of pulse edges of the pulse signal from the first encoder 26 using the home position HP of the carriage 20 as an origin to thereby obtain a count value representing the carriage position in accordance with the instruction of the CPU 61. In detail, the control section 60 compares two phases included in the pulse signal from the first encoder 26 to obtain the moving direction of the carriage 20. Then, the control section 60 increments the count value of the first counter 62 when the moving direction is the forward direction (the +X direction) of getting away from the home position HP, or decrements the count value of the first counter 62 when the moving direction is the backward direction (the −X direction) of getting closer to the home position HP every time the pulse edge is detected in the input signal from the first encoder 26.

The second counter 63 counts the number of pulse edges of the pulse signal from the second encoder 58 using the position where the medium detector 59 has detected the medium M on the conveying path as an origin to thereby obtain a count value representing the conveyance position of the medium M in accordance with the instruction of the CPU 61. In detail, the control section 60 obtains the rotational direction of the conveying roller pair 43 based on the pulse signal from the second encoder 58, and increments the count value of the second counter 63 when the rotational direction is the forward direction, or decrements the count value of the second counter 63 when the rotational direction is the reverse direction every time the pulse edge of the pulse signal is detected.

The memory 65 stores a drying time table TD constituted by table data representing the correspondence relationship between the medium type and the drying time DT besides the programs described above. The control section 60 refers to the drying time table TD to obtain the drying time DT corresponding to the medium type when performing the cartridge replacement control described later.

When the replacement of the liquid cartridge 27 has been instructed, the control section 60 locates the carriage 20 at the first position P1 where the nozzle surface 21A is opposed to the area PCA between the side end M1 on the cap 29 side in the conveying area FA of the medium M and the cap 29 in the first axis direction X. The first position P1 is a position for the user to replace the liquid cartridge 27.

Further, when the replacement of the liquid cartridge 27 has been instructed, the control section 60 performs the evacuation operation of conveying the medium M to evacuate the printed area IA attached with the liquid discharged by the discharge head 21 out of the medium M. The conveying amount of the medium M in the evacuation operation is larger than the dimension of the nozzle surface 21A in the Y-axis direction. Here, when the medium M is left untouched without being evacuated when replacing the liquid cartridge 27, there is a possibility that the medium M absorbs the liquid to swell to thereby curl, and thus, the printed area IA part of the medium M, in particular, floats from the mounting surface 42A. The floating part of the medium M is apt to have contact with the nozzle surface 21A of the discharge head 21. Therefore, the control section 60 evacuates the printed area IA of the medium M from the nozzle surface opposed area HA to which the nozzle surface 21A is opposed using the evacuation operation of the medium M to thereby prevent the medium M and the discharge head 21 from scraping against each other.

When the control section 60 has detected the fact that the replacement of the liquid cartridge 27 has been completed after the evacuation operation, the control section 60 conveys the medium M in the direction toward the −Y side opposite to the direction toward the +Y side which is the conveying direction of the medium M in the evacuation operation, and then discharges the ink on the medium M having been conveyed toward the −Y side. When the user completes the replacement of the liquid cartridge 27, the user closes a cover 20B of the carriage 20, and then closes the maintenance cover 14. When the control section 60 electrically detects the mounting of the liquid cartridge 27, and at the same time, the cover sensor 57 detects the fact that the maintenance cover 14 has been closed, the control section 60 detects the fact that the replacement of the liquid cartridge 27 has been completed. It should be noted that it is also possible to adopt a configuration in which the user notifies the liquid discharge device 11 of the completion of the cartridge replacement work with the button operation of the operation panel 15.

Then, an operation of the liquid discharge device 11 will be described. The control performed by the control section 60 executing the program expressed by the flowchart in FIG. 16 at predetermined time intervals will hereinafter be described. For example, when the remaining amount of the liquid of the liquid cartridge 27 has reached the liquid end, the control section 60 displays an indication of the liquid end and a message for prompting the cartridge replacement on the display section 15A of the operation panel 15 or a display section of the host device. The user who has looked at this message opens the maintenance cover 14 to perform the replacement work of the liquid cartridge 27. The control section 60 performs a variety of types of control for managing the remaining amount in the liquid cartridge 27 and for avoiding a failure when replacing the cartridge. The control related to the cartridge replacement by the user performed by the control section 60 will hereinafter be described with reference to FIG. 16.

Firstly, in the step S11, the control section 60 determines whether or not the liquid end has been reached. The control section 60 obtains the remaining amount of the liquid in the liquid cartridge 27 from the liquid remaining-amount information retrieved from the storage element installed in the liquid cartridge 27. The control section 60 subtracts the consumption of the liquid consumed by the discharge head 21 from the remaining amount of the liquid to figure out the current remaining amount of the liquid. The control section 60 determines whether or not the liquid end has been reached using the current remaining amount of the liquid. The control section 60 terminates the routine when the liquid end has not been reached, or proceeds to the step S12 when the liquid end has been reached.

In the step S12, the control section 60 aborts the printing. The control section 60 aborts the printing in the stage in which the current printing corresponding to one pass of the carriage 20 is completed even in the middle of the printing.

In the step S13, the control section 60 moves the carriage 20 to the home position HP, and then caps the discharge head 21. The control section 60 performs the reverse drive of the carriage motor 23 to move the carriage 20 to the home position. The control section 60 figures out the position of the carriage 20 with the count value of the first counter 62, and starts deceleration of the carriage motor 23 on which the reverse drive is performed when the count value reaches a value of a deceleration start position. Then, when the count value of the first counter 62 has reached the value of the origin, the control section 60 stops the drive of the carriage motor 23 to thereby stop the carriage 20 at the home position HP.

In the step S14, the control section 60 performs the evacuation operation for evacuating the printed area IA of the medium M. In detail, when the replacement of the liquid cartridge 27 has been instructed, the control section 60 performs the evacuation operation of conveying the medium M toward the downstream in the conveying path with the predetermined conveying length FL to evacuate the printed area IA on which the liquid has been discharge by the discharge head 21 out of the medium M toward the +Y side from the nozzle surface opposed area HA. Here, the conveying length FL (see FIG. 13) of the medium M in the evacuation operation is larger than the nozzle surface dimension PL (see FIG. 9) as the dimension in the Y-axis direction of the nozzle surface 21A. As a result, as shown in FIG. 13, the medium M is conveyed toward the +Y side, and the printed area IA is evacuated to the outside of the nozzle surface opposed area HA. In particular in the present embodiment, the conveying length FL of the medium M in the evacuation operation is set to a value with which the whole of the printed area IA can be evacuated to the downstream of the outlet 16 in the conveying path. Therefore, the printed area IA is ejected outside the housing 12 by the evacuation operation. Here, the inside of the housing 12 where the processing in which the liquid such as the ink is discharged is performed is higher in humidity compared to the outside of the housing 12. Therefore, by evacuating the printed area IA to the outside of the housing 12, drying of the liquid in the printed area IA is facilitated compared to the case in which the printed area IA is located inside the housing 12.

In the step S15, the control section 60 starts timing. Specifically, the control section 60 starts timing by the timer 64. Thus, the timing of the elapsed time from when the printed area IA has been ejected outside the housing 12, namely the timing of the drying time DT for drying the printed area IA outside the housing 12, is started.

In the step S16, the control section 60 judges whether or not the liquid cartridge replacement instruction has been made. In the present embodiment, the liquid cartridge replacement instruction is received due to the fact that the cover sensor 57 has detected the fact that the maintenance cover 14 has been opened by the user who has learned the liquid end from the message displayed on the display section 15A of the operation panel 15 and so on. In other words, the input of the detection signal from the cover sensor 57 which has detected the fact that the maintenance cover 14 has been opened by the user in the state in which the liquid end flag is set is regarded by the control section 60 as the issuance of the liquid cartridge replacement instruction. The control section 60 proceeds to the step S17 when the liquid cartridge replacement instruction has been made, or waits still when the liquid cartridge replacement instruction has not been made. It should be noted that the input of the detection signal from the cover sensor 57 is regarded as the issuance of the liquid cartridge replacement instruction in the present embodiment, it is also possible to judge that the liquid cartridge replacement instruction has been issued when a predetermined operation to the operation panel 15 has been made. Further, it is also possible to adopt a configuration in which it is judged that the liquid cartridge replacement instruction has been made when the liquid end flag has been set.

In the step S17, the control section 60 moves the carriage 20 to the first position P1 where the cartridge replacement should be performed. In detail, the control section 60 moves down the cap 29 which is in the capping state of having contact with the nozzle surface 21A of the discharge head 21 shown in FIG. 6, and then performs the forward drive of the carriage motor 23 to move the carriage 20 from the home position HP shown in FIG. 6 to the first position P1 shown in FIG. 7. The first position P1 is a position where the nozzle surface 21A is opposed to the area PCA between the side end M1 on the cap 29 side in the conveying area FA of the medium M and the cap 29 in the X-axis direction. When the carriage 20 stops at the first position P1, the user opens the cover 20B of the carriage 20 to remove the liquid cartridge 27 in the liquid end state from the carriage 20. Then, the user mounts a new liquid cartridge 27 on the carriage 20, or when the liquid cartridge 27 is of a refill type, the user injects the liquid into the liquid cartridge 27, and then mounts the liquid cartridge 27 refilled with the liquid due to the injection on the carriage 20. When the user mounts the liquid cartridge 27, it results in that the liquid cartridge 27 is pushed in as shown in FIG. 8. When pushing the liquid cartridge 27 in the carriage 20 when mounting the liquid cartridge 27 on the carriage 20, the component made of synthetic resin such as the carriage 20 deforms for a moment due to the pushing force. On this occasion, the discharge head 21 moves down for a moment due to the deformation of the carriage 20, but the first projections 51 and the second projections 52 have contact with each other to prevent the nozzle surface 21A from further moving downward. As a result, the gap GH is kept between the nozzle surface 21A and the upper surface of the bottom frame 19 opposed to the nozzle surface 21A, and the contact between the nozzle surface 21A and the bottom frame 19 is avoided. When the user completes the replacement of the liquid cartridge 27, the user closes the cover 20B, and further closes the maintenance cover 14.

In the step S18, the control section 60 judges whether or not the replacement of the liquid cartridge 27 has been detected. The control section 60 judges whether or not the replacement of the liquid cartridge 27 has been detected after the evacuation operation. The control section 60 detects the replacement of the liquid cartridge 27 using electrical disconnection and reconnection to the storage elements of the respective liquid cartridges 27 around the replacement of the cartridge. When the user completes the cartridge replacement work, the user closes the cover 20B, and further closes the maintenance cover 14.

In the step S19, the control section 60 judges whether or not the closed state of the maintenance cover 14 has been detected. The control section 60 proceeds to the step S20 when the closed state of the maintenance cover 14 has been detected, or waits still when the closed state of the maintenance cover 14 has not been detected.

In the step S20, the control section 60 moves the carriage 20 to the home position HP.

In the step S21, the control section 60 performs cleaning. When the carriage 20 stops at the home position HP, the control section 60 move the cap 29 up to cap the nozzle surface 21A of the discharge head 21. Then, the control section 60 drives the maintenance device 28 to perform the cleaning of providing the negative pressure to the closed space between the nozzle surface 21A and the cap 29 by exhausting the air with the pump 30 to thereby forcibly suction and eject the ink from the nozzles N which open on the nozzle surface 21A. Due to the cleaning, the bubbles and so on mixed in the ink flow channel on the carriage 20 side when replacing the cartridge are ejected and thus removed from the nozzles N together with the ink. When the cleaning is completed, flashing for discharging the liquid irrelevant to the printing from the nozzles N of the discharge head 21, and wiping for wiping the nozzle surface 21A with the wiper 31 are performed in a predetermined order.

On this occasion, in the process of wiping the nozzle surface 21A with the wiper 31, since the slope 53 is used when performing the wiping with the wiper 31, the wiper 31 performs the wiping action with the wiping stroke equal to or longer than the dimension obtained by adding the head width HL and the slope dimension WL to each other. When the discharge head 21 has moved to the wiping completion position, there is achieved the positional relationship in which the discharge head 21 and the medium M are opposed to each other in the vertical direction Z. However, since the printed area IA has already been evacuated from the nozzle surface opposed area HA, there is no chance for the nozzle surface 21A to scrape against the printed area IA.

In the step S22, the control section 60 judges whether or not the drying time DT corresponding to the medium type has elapsed. The control section 60 refers to the drying time table TD to obtain the drying time DT corresponding to the medium type based on the medium type obtained from the medium type information included in the print data. When the drying time DT has not elapsed at the present moment when the cleaning operation has been completed up to the wiping, the control section 60 waits until the drying time DT elapses. On the other hand, when the drying time DT has elapsed, the control section 60 proceeds to the step S23.

In the step S23, the control section 60 returns the medium M to the position before the evacuation. Specifically, the control section 60 performs the reverse drive of the conveying motor 41 to convey the medium M dried after the elapse of the drying time DT in the direction toward the −Y side opposite to the direction toward the +Y side as the conveying direction from the evacuation position to return the medium M to the original position before the evacuation. It should be noted that the position before the evacuation is obtained by retrieving the value which has been stored in the memory 65 when the control section 60 has evacuated the medium M. Further, the position to which the medium M is moved backward after being dried is not strictly limited to the position before the evacuation, but the medium M is moved backward excessively as much as a predetermined distance within a range of the distance 1 through 10 times as large as the pitch of the print pixels. In the present embodiment, the medium M is moved backward to the position where the printing is performed with an overlap having the predetermined overlapping dimension ΔL (FIG. 14) within the range of 1 through 3 dots. It is preferable to move the medium M backward to a reprint start position where it results in that the area to be printed from the reprint start position partially overlaps the printed area IA on which the liquid has adhered before the medium M has been evacuated in such a manner. It should be noted that it is also possible to move the medium M backward to the reprint start position where the area to be printed from the reprint start position becomes the area adjacent on the downstream to the printed area IA.

In the step S24, the control section 60 resumes the printing. The printing is resumed from the next to the abort position at which the printing has been aborted for the replacement of the liquid cartridge 27. In the present embodiment, the printing is resumed so as to partially overlap the printed area IA on which the liquid has adhered before the medium M has been evacuated as much as the predetermined dimension ΔL. Therefore, the banding is hard to occur in the place where the reprint is started.

According to the present embodiment described hereinabove in detail, it is possible to obtain the advantages described below.

The liquid discharge device is provided with the discharge head 21, the carriage 20, the cap 29, and the control section 60. The discharge head 21 is configured to discharge the liquid on the medium M conveyed. The discharge head 21 and the liquid cartridge 27 configured to contain the liquid to be supplied to the discharge head 21 are mounted on the carriage 20. The carriage 20 moves in the first axis direction. The cap 29 is disposed outside the conveying area FA, as the range in which the medium M is conveyed, in the first axis direction, and is configured to have contact with the nozzle surface 21A of the discharge head 21 on which nozzles N open. The control section 60 controls the carriage 20 to move. When the replacement of the liquid cartridge 27 is performed, the control section 60 locates the carriage 20 at the first position P1 where the nozzle surface 21A faces to the area PCA between the conveying area FA and the cap 29 in the first axis direction. Therefore, when the replacement of the liquid cartridge 27 is performed, the carriage 20 is located at the first position P1. Even when the carriage 20 is pushed in toward the discharge head 21 by the user who replaces the liquid cartridge 27, and as a result, the liquid is leaked on the nozzle surface 21A from the nozzles N due to the influence of the pushing pressure, the medium M does not exist at the position opposed to the nozzle surface 21A, and in addition, the discharge head 21 does not pass above the medium M in the process in which the discharge head 21 moves to the maintenance position. Therefore, the concern that a droplet drops from the discharge head 21 on the medium M, or the nozzle surface 21A scrapes against the bulging medium M does not exist. Further, since the replacement of the liquid cartridge 27 is performed at a place other than the cap 29, the contact between the discharge head 21 and the cap 29 can also be avoided. Therefore, even in the state in which the medium M exists in the conveying area FA such as when the liquid end occurs in the process of the printing, it is possible to appropriately perform the replacement of the liquid cartridge 27 without making the medium M dirty with the liquid.

The liquid discharge device 11 has projections 51 which can have contact with the carriage surface 20C of the carriage 20 when the carriage 20 is located at the first position P1. The carriage surface 20C is configured to face to the medium M conveyed. And when the carriage surface 20C and the projections 51 have contact with each other, the cap GH exists between the nozzle surface 21A and the surface opposed to the nozzle surface 21A. Therefore, even when the discharge head 21 is displaced downward due to the influence of the pushing pressure applied to the carriage 20 when replacing the liquid cartridge 27, it is possible to prevent the situation of having contact with the opposed surface and so on.

The liquid discharge device 11 is provided with the conveying section 40 configured to convey the medium M in the Y-axis direction crossing the X-axis direction. When the replacement of the liquid cartridge 27 is performed, the control section 60 performs the evacuation operation. In the evacuation operation, the control section 60 controls conveying the medium M to evacuate the printed area IA of the medium M, on which the liquid discharged by the discharge head 21, in the Y-axis direction. The conveying length of the medium M in the evacuation operation is larger than the dimension in the Y-axis direction of the nozzle surface 21A. Therefore, there is a possibility that the printed area IA attached with the liquid out of the medium M bulges due to the swelling with the liquid. Due to the evacuation operation, the printed area IA on which the liquid has been discharged in the medium M is evacuated with the conveying length FL larger than the dimension in the Y-axis direction of the nozzle surface 21A. Therefore, in the nozzle surface opposed area HA which can be opposed to the nozzle surface 21A of the discharge head 21, the printed area IA of the medium M is not located, but the area of the medium M on which the liquid has not yet discharged is located. For example, even when the discharge head 21 has moved for the maintenance or the printing toward the opposite side to the cap 29 in the X-axis direction beyond the first position P1 where the replacement of the liquid cartridge 27 has been performed, it is possible to prevent the nozzle surface 21A of the discharge head 21 and the printed area IA of the medium M from scraping against each other.

When the control section 60 has detected the fact that the replacement of the liquid cartridge 27 has been completed after the evacuation operation, the control section 60 conveys the medium M in the opposite direction to the conveying direction of the medium M in the evacuation operation. And then, after the medium M had been conveyed in the opposite direction, the control section 60 discharges the liquid on the medium M. Therefore, even when the liquid end occurs in the process of the printing, since the evacuation operation of the medium M is performed when the replacement of the liquid cartridge 27 is performed, it is possible to resume the printing from the rest when the liquid end has occurred after the replacement of the liquid cartridge 27 while preventing the dirt of the medium M with the liquid due to the contact between the medium M and the discharge head 21. It should be noted that the reprinting is resumed from the position partially overlapping the printed area IA on which the liquid discharge has been performed before the evacuation, or resumed from the area adjacent on the upstream to the printed area IA. Therefore, it is possible to prevent the banding (the white stripe) from occurring in the place where the reprint is started.

The control section 60, in the evacuation operation, locates the printed area IA on which the liquid has been discharged at a position that is in the opposite direction from the nozzle surface opposed area HA which can be opposed to the nozzle surface 21A in the conveying direction. The opposite direction is opposite to a direction toward an area on which the liquid has not yet been discharged by the discharge head 21 from the nozzle surface opposed area HA. Therefore, since the part located in the nozzle surface opposed area HA which can be opposed to the nozzle surface 21A out of the medium M after the evacuation operation is a non-printed area, even when the discharge head 21 moves to the conveying area FA side of the first position P1 in order to perform the maintenance after the evacuation operation, it is possible to reduce the scrape between the nozzle surface 21A and the medium M. Further, since the printed area IA on which the liquid has been discharged is evacuated toward the opposite side to the non-printed area on which the liquid has not yet been discharged by the discharge head 21, it is possible to avoid transfer of the liquid from the printed area IA of the medium M to the conveying roller pair 43 constituting the conveying section 40. For example, it is possible to avoid making the non-printed area on which the liquid has not yet been discharged in the medium M dirty with the liquid having been transferred to the conveying roller pair 43 when the conveying section 40 subsequently conveys the medium M.

The liquid discharge device 11 is provided with the housing 12 having the outlet 16 where the medium M on which the liquid has been discharged is ejected. The control section 60, in the evacuation operation, locates the printed area IA on which the liquid has been discharged outside the housing 12 from the outlet 16. Therefore, since the discharge of the liquid by the discharge head 21 is performed inside the housing 12, the inside of the housing 12 is higher in humidity compared to the outside of the housing 12. By locating the printed area IA on which the liquid has been discharged of the medium M in the outside of the housing 12 where the humidity is lower compared to the inside of the housing 12, drying of the printed area IA on which the liquid has been discharged of the medium M is facilitated. In the process of or after returning the medium M to the inside of the housing 12 with the backward conveyance, it is possible to reduce the scrape between the medium M and the discharge head 21.

There is provided the method of controlling the liquid discharge device provided with the discharge head 21, the cap 29, and the carriage 20, wherein the discharge head 21 is configured to discharge the liquid on the medium M conveyed, the cap 29 is configured to have contact with the nozzle surface 21A of the discharge head 21, the liquid cartridge 27 and the discharge head 21 are mounted on the carriage 20, and the carriage 20 moves in the first axis direction. In this control method, when the replacement of the liquid cartridge 27 is performed, the carriage 20 is moved to locate the nozzle surface 21A at the position where the nozzle surface 21A faces to the area PCA between the conveying area FA of the medium M and the cap 29 in the X-axis direction. According to the method of controlling the liquid discharge device 11, it is possible to similarly obtain the advantage of described above.

The embodiment described above can also be modified as the modified examples described hereinafter. It is also possible to arbitrarily combine the configuration included in the embodiment described above and the configuration included in any of the modified examples with each other, or it is also possible to arbitrarily combine the configurations included in the respective modified examples described above with each other.

The liquid container is not limited to the liquid cartridge 27, but can also be an adapter or a tank installed in an upper part of the carriage 20. When the liquid container is the adapter or the tank, it is possible to adopt a type of performing the refill of the liquid while keeping the adapter or the tank mounted on the carriage 20, or it is also possible to adopt a type of performing the refill of the liquid after detaching the adapter or the tank from the carriage 20. The adapter or the tank has an inlet for injecting the liquid, and a plug section of the inlet is removed, then a spout section of a bottle as an example of the refilling container is inserted into the inlet of the adapter or the tank on the carriage 20, and then the adapter or the tank is refilled with the ink from the bottle. When the adapter or the tank is refilled with the liquid while keeping the adapter or the tank mounted on the carriage 20, the user presses the carriage 20 downward in some cases when inserting the spout section of the bottle into the inlet of the adapter or the tank to inject the liquid, or the user pushes the carriage 20 downward in some cases when fitting the plug section into the inlet after completion of the injection of the liquid. The liquid leaked from the nozzles N of the discharge head 21 due to the deformation of the carriage 20 by the influence of the pushing pressure at that moment adheres to the nozzle surface 21A or drops as a droplet in some cases. Further, in the type of injecting the liquid after detaching the adapter or the tank from the carriage 20, the carriage 20 is pushed downward when mounting the adapter or the tank on the carriage 20 after refilling the adapter or the tank detached from the carriage 20 with the liquid. The liquid leaked from the nozzles N of the discharge head 21 due to the deformation of the carriage 20 by the influence of the pushing pressure at that moment adheres to the nozzle surface 21A or drops as a droplet in some cases. Even when using such a liquid container as the adapter or the tank, the control section 60 locates the carriage 20 at the position where the nozzle surface 21A is opposed to the area PCA between the side end M1 on the cap 29 side in the medium M and the cap 29 in the first axis direction when the refill of the liquid container with the liquid is instructed, namely the refill of the liquid container with the liquid is performed. Therefore, when performing the replacement of the liquid container or the refill of the liquid container with the liquid, the concern that a droplet drops from the discharge head 21 to the medium M, or the bulging medium M and the nozzle surface 21A scrape against each other does not exist. Further, since the replacement of the liquid container or the refill of the liquid container with the liquid is performed at the position not opposed to the cap 29, it is also possible to avoid the contact between the discharge head 21 and the cap 29 when the pushing pressure is applied to the carriage 20. Further, when providing the projections 51, by the carriage surface having contact with the projections 51 when replacing the liquid container or refilling the liquid container with the liquid, it is possible to prevent the contact between the nozzle surface 21A and the surface opposed to the nozzle surface 21A. The deterioration of the lyophobic property of a lyophobic layer provided to the nozzle surface 21A due to the scrape of the nozzle surface 21A of the discharge head 21 can be avoided. It should be noted that the liquid container can also be a bag body such as an ink pack to be mounted on the carriage 20. Further, when the refill of the liquid container with the liquid is performed, a liquid refilling instruction is received due to the fact that the cover sensor 57 has detected the fact that the maintenance cover 14 has been opened by the user who has learned the liquid end from the message displayed on the display section 15A of the operation panel 15 and so on similarly to the judgment on whether or not the liquid cartridge replacement instruction has been made expressed in the step S16. In other words, the input of the detection signal from the cover sensor 57 which has detected the fact that the maintenance cover 14 has been opened by the user in the state in which the liquid end flag is set is regarded by the control section 60 as the issuance of the liquid refilling instruction. In the present modified example, when the refill of the liquid container with the liquid is performed, the control section 60 performs the operation of moving the carriage 20 to the first position P1 and the evacuation operation. When the control section 60 has detected the fact that the refill of the liquid container with the liquid has been completed after the evacuation operation, the control section 60 conveys the medium M toward the opposite direction to the conveying direction of the medium M in the evacuation operation, and then discharges the liquid on the medium M having been conveyed toward the opposite direction. Therefore, even when the liquid end occurs in the process of the printing, since the evacuation operation of the medium M is performed when the refill of the liquid container with the liquid is performed, it is possible to resume the print processing to the medium from the rest when the liquid end has occurred after the refill of the liquid container with the liquid is completed while preventing the dirt of the medium M with the liquid due to the contact between the medium M and the discharge head 21.

In the embodiment described above, the number of the liquid cartridges 27 as an example of the liquid container to be mounted on the carriage 20 can be one. It is also possible to adopt a configuration in which a single cartridge of a single color of, for example, black is mounted on the carriage.

When the liquid is the ink, the liquid includes a variety of liquid compositions such as generic aqueous ink, oil ink, gel ink or hot-melt ink.

The liquid is not limited to the ink, but is sufficient to be able to be discharged from the liquid discharge device. For example, the liquid can also be a cleaning liquid or ultraviolet curable resin. Further, the liquid includes a liquid material including particles of a functional material in a dispersed state.

The medium is not limited to the continuous medium fed from the roll body. When the liquid discharge device is provided with a function of resuming the printing from the rest when the liquid end has occurred after the replacement of the liquid container or the refill of the liquid container with the liquid when, for example, the liquid end has occurred in the process of the printing, it is also possible to use, for example, a large-sized cut form.

The medium is not limited to the form, but can also be a film or a sheet made of synthetic resin, woven fabric, nonwoven fabric, a laminate sheet, foil made of metal, and so on.

Hereinafter, the technical thought figured out from the embodiment and the modified examples described above will be transferred together with the advantages thereof.

The liquid discharge device includes a discharge head configured to discharge a liquid on a medium conveyed, a carriage on which the discharge head and a liquid container configured to contain the liquid to be supplied to the discharge head are mounted, and which moves in a first axis direction, a cap disposed outside a conveying area as a range in which the medium is conveyed in the first axis direction, and configured to have contact with a nozzle surface on which a nozzle of the discharge head opens, and a control section configured to control a translation of the carriage, wherein the control section locates the carriage at a first position where the nozzle surface is opposed to an area between a side end at the cap side in the conveying area and the cap in the first axis direction when one of replacement of the liquid container and refill of the liquid container with the liquid is performed.

According to this configuration, when the replacement of the liquid container or the refill of the liquid container with the liquid is performed, the carriage is located at the first position. Even when the carriage is pushed in toward the discharge head for the replacement of the liquid container or the refill of the liquid container with the liquid, and as a result, the liquid is leaked on the nozzle surface from the nozzle due to an influence of the pushing pressure, the medium does not exist at the position opposed to the nozzle surface, and in addition, the discharge head does not pass above the medium in the process in which the discharge head moves to the maintenance position. Therefore, the concern that a droplet drops from the discharge head to the medium, or the nozzle surface scrapes against the bulging medium does not exist. Further, since the replacement of the liquid container or the refill of the liquid container with the liquid is performed at a place other than the cap, the contact between the discharge head and the cap can also be avoided. Therefore, even in the state in which the medium exists in the conveying area, the replacement of the liquid container or the refill of the liquid container with the liquid can appropriately be performed without making the medium dirty with the liquid.

In the liquid discharge device described above, there may further be included a projection configured to have contact with the carriage surface as a surface at a side of the medium conveyed out of the carriage when the carriage is located at the first position, wherein a gap may be provided between the nozzle surface and a surface opposed to the nozzle surface when the carriage surface and the projection have contact with each other.

According to this configuration, even when the discharge head is displaced downward due to the influence of the pushing pressure applied to the carriage when replacing the liquid container or refilling the liquid container with the liquid, it is possible to prevent the situation of having contact with the opposed surface and so on.

In the liquid discharge device described above, there may further be included a conveying section configured to convey the medium in a second axis direction crossing the first axis direction, wherein the control section may perform an evacuation operation of conveying the medium to evacuate an area on which the liquid has been discharged by the discharge head out of the medium toward the second axis direction when one of the replacement of the liquid container and the refill of the liquid container with the liquid is performed, and a conveying length of the medium in the evacuation operation may be larger than a dimension in the second axis direction of the nozzle surface.

According to the present configuration, there is a possibility that the area attached with the liquid out of the medium bulges due to the swelling with the liquid. Due to the evacuation operation, the area on which the liquid has been discharged in the medium is evacuated with the conveying length larger than the dimension in the second axis direction of the nozzle surface. Therefore, when the discharge head moves in the first axis direction, the area attached with the liquid of the medium does not exist in an area to which the nozzle surface can be opposed. Even when the discharge head moves for the maintenance or the resumption of the liquid discharge processing in the first axis direction toward the opposite side to the cap beyond the position where the replacement of the liquid container or the refill of the liquid container with the liquid is performed, it is possible to prevent the scrape between the nozzle surface of the discharge head and the part attached with the liquid of the medium.

In the liquid discharge device described above, when performing the replacement of the liquid container out of the replacement of the liquid container and the refill of the liquid container with the liquid, the control section may convey the medium toward an opposite direction to a conveying direction of the medium in the evacuation operation, and may discharge the liquid on the medium having been conveyed toward the opposite direction when the control section has detected that the replacement of the liquid container is completed after the evacuation operation.

According to the present configuration, even when the liquid end occurs in the process of the liquid discharge processing, since the evacuation operation of the medium is performed when the replacement of the liquid container is performed, it is possible to resume the liquid discharge processing to the medium from the rest when the liquid end has occurred after the replacement of the liquid container is completed while preventing the dirt of the medium due to the contact between the medium and the discharge head.

In the liquid discharge device described above, when performing the refill of the liquid container with the liquid out of the replacement of the liquid container and the refill of the liquid container with the liquid, the control section may convey the medium toward an opposite direction to a conveying direction of the medium in the evacuation operation, and may discharge the liquid on the medium having been conveyed toward the opposite direction when the control section has detected that the refill of the liquid container with the liquid is completed after the evacuation operation.

According to the present configuration, even when the liquid end occurs in the process of the liquid discharge processing, since the evacuation operation of the medium is performed when the refill of the liquid container with the liquid is performed, it is possible to resume the liquid discharge processing to the medium from the rest when the liquid end has occurred after the refill of the liquid container with the liquid is completed while preventing the dirt of the medium with the liquid due to the contact between the medium and the discharge head.

In the liquid discharge device described above, the control section may locate the area on which the liquid has been discharged at an opposite side to an area on which the liquid has not yet been discharged by the discharge head about an area which can be opposed to the nozzle surface in the second axis direction in the evacuation operation.

According to the present configuration, since the part located in the area which can be opposed to the nozzle surface out of the medium after the evacuation operation is a non-printed part, the bulge of the medium in the area which can be opposed to the nozzle surface is hard to occur. Therefore, even when the carriage moves to the conveying area side of the first position for the maintenance, the contact between the nozzle surface of the discharge head and the medium can be avoided. Further, since the area on which the liquid has been discharged is evacuated to the opposite side to the area on which the liquid has not yet been discharged by the discharge head, transfer of the liquid from the medium to the constituent member of the conveying section can be avoided. For example, it is possible to avoid making the area on which the liquid has not yet been discharged in the medium dirty with the liquid having been transferred when the conveying section subsequently conveys the medium.

In the liquid discharge device described above, there may further be included a housing having an outlet from which the medium on which the liquid has been discharged, wherein the control section may locate the area on which the liquid has been discharged outside the housing from the outlet in the evacuation operation.

According to the present configuration, since the discharge of the liquid by the discharge head is performed inside the housing, the inside of the housing is higher in humidity compared to the outside of the housing. By locating the area on which the liquid has been discharged of the medium in the outside of the housing where the humidity is lower compared to the inside of the housing, drying of the area on which the liquid has been discharged of the medium is facilitated. In the process of or after returning the medium to the inside of the housing with the backward conveyance, it is possible to reduce the scrape between the medium and the discharge head.

The method of controlling a liquid discharge device is a method of controlling a liquid discharge device including a discharge head configured to discharge a liquid on a medium conveyed, a cap configured to have contact with a nozzle surface of the discharge head, and a carriage on which the liquid container and the discharge head are mounted, and which moves in a first axis direction, the method including the step of moving the carriage to locate the nozzle surface at a position opposed to an area between a side end at the cap side in a conveying area of the medium and the cap in the first axis direction when one of replacement of the liquid container and refill of the liquid container with the liquid is performed. According to this method, substantially the same functions and advantages as those of the liquid discharge device described above can be obtained.

What is claimed is:

1. A liquid discharge device comprising:

a discharge head configured to discharge a liquid on a medium conveyed;

a carriage on which the discharge head and a liquid container are mounted configured to move in a first axis direction, the liquid container being configured to contain the liquid to be supplied to the discharge head;

a cap disposed outside a conveying area in the first axis direction, and configured to have contact with a nozzle surface of the discharge head, the nozzle surface being a surface on which a nozzle opens, and the conveying area being a range in which the medium is conveyed; and a control section configured to control moving of the carriage, wherein the control section locates the carriage at a first position where the entirety of nozzle surface of the discharge head faces an area between the conveying area and the cap in the first axis direction when one of replacement of the liquid container or refill of the liquid container with the liquid is performed.

2. The liquid discharge device according to claim 1, further comprising:

a projection configured to have contact with a carriage surface of the carriage when the carriage is located at the first position, the carriage surface being configured to face to the medium conveyed, wherein a gap is provided between the nozzle surface and a surface opposed to the nozzle surface when the carriage surface and the projection have contact with each other.

3. The liquid discharge device according to claim 1, further comprising:

a conveying section configured to convey the medium in a second axis direction, the second axis direction crossing the first axis direction, wherein the control section performs an evacuation operation of conveying the medium to evacuate an area, of the medium, on which the liquid has been discharged by the discharge head along the second axis direction when one of the replacement of the liquid container and the refill of the liquid container with the liquid is performed, and a conveying length of the medium in the evacuation operation is larger than a dimension in the second axis direction of the nozzle surface.

4. The liquid discharge device according to claim 3, wherein the control section locates the carriage at the first position when the replacement of the liquid container is performed, and when the control section has detected that the replacement of the liquid container is completed after the evacuation operation, the control section conveys the medium in an opposite direction to a conveying direction of the medium in the evacuation operation, and discharges the liquid on the medium after the medium had been conveyed in the opposite direction.

5. The liquid discharge device according to claim 3, wherein the control section locates the carriage at the first position when the refill o the liquid container is performed, and when the control section has detected that the refill of the liquid container is completed after the evacuation operation, the control section conveys the medium in an opposite direction to a conveying direction of the medium in the evacuation operation, and discharges the liquid on the medium after the medium had been conveyed in the opposite direction.

6. The liquid discharge device according to claim 3, wherein the control section, in the evacuation operation, locates the area on which the liquid has been discharged at a position that is in a first direction from a nozzle surface opposed area in the second axis direction, the nozzle surface opposed area being an area in which the nozzle surface configured to the conveyed medium, and the first direction being opposite to a direction, along the second axis direction, from the nozzle surface opposed area toward an area on which the liquid has not yet been discharged by the discharge unit.

7. The liquid discharge device according to claim 3, further comprising:

a housing having an outlet from which the medium on which the liquid has been discharged, wherein the control section, in the evacuation operation, locates the area on which the liquid has been discharged outside the housing from the outlet.

8. A method of controlling a liquid discharge device including a discharge head configured to discharge a liquid on a medium conveyed, a cap configured to have contact with a nozzle surface of the discharge head, the nozzle surface being a surface on which a nozzle opens, and a carriage on which the discharge head and the liquid container are mounted configured to move in a first axis direction, the method comprising:

moving the carriage to locate the nozzle surface at a position where the entirety of nozzle surface of the discharge head faces an area between a conveying area of the medium and the cap in the first axis direction when one of replacement of the liquid container or refill of the liquid container with the liquid is performed.

* * * * *